US007255351B2

(12) United States Patent
Yoseloff et al.

(10) Patent No.: US 7,255,351 B2
(45) **Date of Patent: *Aug. 14, 2007**

(54) INTERACTIVE SIMULATED BLACKJACK GAME WITH SIDE BET APPARATUS AND IN METHOD

(75) Inventors: Mark L. Yoseloff, Henderson, NV (US); R. Brooke Dunn, Henderson, NV (US); Philip S. Smith, Las Vegas, NV (US); Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 295 days.

This patent is subject to a terminal disclaimer.

(21) Appl. No.: 10/945,369

(22) Filed: Sep. 20, 2004

(65) Prior Publication Data

US 2005/0035548 A1 Feb. 17, 2005

Related U.S. Application Data

(63) Continuation-in-part of application No. 10/272,407, filed on Oct. 15, 2002, now Pat. No. 6,808,173, and a continuation-in-part of application No. 10/764,827, filed on Jan. 26, 2004, and a continuation-in-part of application No. 10/764,994, filed on Jan. 26, 2004, and a continuation-in-part of application No. 10/764, 995, filed on Jan. 26, 2004.

(51) Int. Cl.
*A63F 3/08* (2006.01)

(52) U.S. Cl. ..... 273/274; 273/292; 273/309

(58) Field of Classification Search ..... 273/274
See application file for complete search history.

(56) References Cited

U.S. PATENT DOCUMENTS 3,595,987 A 7/1971 Vlahos
4,007,487 A 2/1977 Vlahos
4,026,555 A 5/1977 Kirschner et al.
4,100,569 A 7/1978 Vlahos
4,344,085 A 8/1982 Vlahos (Continued)

FOREIGN PATENT DOCUMENTS

| | | |
|---|---|---|
| JP | 2660586 | 6/1997 |
| WO | WO 00/30856 | 6/2000 |
| WO | WO 00/51076 | 8/2000 |

OTHER PUBLICATIONS

"Over/Under 13 Blackjack", Product Brochure published by Gaming Concepts, Inc. 3 pages (1988).

*Primary Examiner*—Eugene Kim
*Assistant Examiner*—Dolores R. Collins
(74) *Attorney, Agent, or Firm*—Mark A. Litman & Associates, P.A.

(57) ABSTRACT

A multi-player automated casino table card game platform enables play of casino table BLACKJACK-type games according to rules effected through a processor. Rules may include games similar to standard blackjack or Twenty-One with an additional bonus event present in the play of the game. The game play may include optionally placing a wager on the auxiliary card game; dealing a first number of cards to a player; dealing a second number of cards to the dealer; displaying at least one of the player's cards; displaying at least one of the dealer's cards; wherein if at least one of the displayed player's cards or at least one of the displayed dealer's cards is a card of a specific predetermined rank, paying a player who has placed the optional wager for the occurrence of the at least one card of a specific predetermined rank being displayed in either the exposed card(s) of the dealer's hand and/or the player's hand; and then continuing deal of cards according to the rules of the underlying game and continuing play of the underlying game.

49 Claims, 9 Drawing Sheets

U.S. PATENT DOCUMENTS

| | | | | |
|---|---|---|---|---|
| 4,397,509 | A | 8/1983 | Miller et al. | |
| 4,445,114 | A | 4/1984 | Stubben | |
| 4,508,353 | A | 4/1985 | Meyer et al. | |
| 4,530,499 | A | 7/1985 | Breslow et al. | |
| 4,614,342 | A | 9/1986 | Takashima | |
| 4,643,421 | A | 2/1987 | Meyer et al. | |
| 4,658,427 | A | 4/1987 | Aubin | |
| 4,667,959 | A | 5/1987 | Pfeiffer et al. | |
| 4,687,200 | A | 8/1987 | Shirai | |
| 4,724,307 | A | 2/1988 | Dutton et al. | |
| 4,738,451 | A | 4/1988 | Logg | |
| 4,807,884 | A | 2/1989 | Breeding | |
| 4,861,041 | A | 8/1989 | Jones et al. | |
| 4,887,819 | A | 12/1989 | Walker | |
| 4,926,327 | A | 5/1990 | Sidley | |
| 4,995,615 | A | 2/1991 | Cheng | |
| 5,000,453 | A | 3/1991 | Stevens et al. | |
| 5,090,708 | A | 2/1992 | Gerlitz et al. | |
| 5,120,057 | A | 6/1992 | Kitaue | |
| 5,125,671 | A | 6/1992 | Ueda et al. | |
| 5,149,104 | A | 9/1992 | Edelstein | |
| 5,150,899 | A | 9/1992 | Kitaue | |
| 5,159,549 | A | 10/1992 | Hallman, Jr. et al. | |
| 5,174,579 | A | 12/1992 | Griffiths | |
| 5,221,083 | A | 6/1993 | Dote | |
| 5,275,416 | A | 1/1994 | Schorr et al. | |
| 5,288,077 | A | 2/1994 | Jones | |
| 5,288,078 | A | 2/1994 | Capper et al. | |
| 5,317,505 | A | 5/1994 | Karabed et al. | |
| 5,356,145 | A | 10/1994 | Verschoor | |
| 5,364,105 | A | 11/1994 | Jones | |
| 5,374,061 | A | 12/1994 | Albrecht | |
| 5,377,973 | A | 1/1995 | Jones et al. | |
| 5,397,128 | A | 3/1995 | Hesse et al. | |
| 5,414,256 | A | 5/1995 | Gurner et al. | |
| 5,453,758 | A | 9/1995 | Sato | |
| 5,454,570 | A | 10/1995 | Karal | |
| 5,470,080 | A | 11/1995 | Naka et al. | |
| 5,521,616 | A | 5/1996 | Capper et al. | |
| 5,577,731 | A | 11/1996 | Jones | |
| 5,586,766 | A | 12/1996 | Forte et al. | |
| 5,586,936 | A | 12/1996 | Bennett et al. | |
| 5,605,334 | A | 2/1997 | McCrea, Jr. | |
| 5,616,078 | A | 4/1997 | Oh | |
| 5,632,485 | A | 5/1997 | Woodland et al. | |
| 5,636,842 | A | 6/1997 | Cabot et al. | |
| 5,669,816 | A | 9/1997 | Garczynski et al. | |
| 5,673,917 | A | 10/1997 | Vancura | |
| 5,676,372 | A * | 10/1997 | Sines et al. | 273/149 R |
| 5,681,039 | A | 10/1997 | Miller | |
| 5,683,085 | A | 11/1997 | Johnson et al. | |
| 5,688,174 | A | 11/1997 | Kennedy | |
| 5,695,189 | A | 12/1997 | Breeding et al. | |
| 5,722,893 | A | 3/1998 | Hill et al. | |
| 5,725,216 | A | 3/1998 | Jones | |
| 5,726,706 | A | 3/1998 | Walsh | |
| 5,735,742 | A | 4/1998 | French | |
| 5,743,532 | A | 4/1998 | Lafferty | |
| 5,745,166 | A | 4/1998 | Rhodes et al. | |
| 5,779,546 | A | 7/1998 | Meissner et al. | |
| 5,781,647 | A | 7/1998 | Fishbine et al. | |
| 5,803,453 | A | 9/1998 | Stephan et al. | |
| 5,816,575 | A | 10/1998 | Keller | |
| 5,820,460 | A | 10/1998 | Fulton | |
| 5,831,527 | A | 11/1998 | Jones, II et al. | |
| 5,839,730 | A | 11/1998 | Pike | |
| 5,879,235 | A | 3/1999 | Kaneko et al. | |
| 5,897,235 | A | 4/1999 | Honma | |
| 5,919,090 | A | 7/1999 | Mothwurf | |
| 5,923,364 | A | 7/1999 | Rhodes et al. | |
| 5,934,675 | A | 8/1999 | Handelman et al. | |
| 5,934,998 | A | 8/1999 | Forte et al. | |
| 5,941,769 | A | 8/1999 | Order | |
| 5,944,310 | A | 8/1999 | Johnson et al. | |
| 5,961,121 | A | 10/1999 | Brown | |
| 5,976,019 | A | 11/1999 | Ikeda et al. | |
| 5,979,897 | A | 11/1999 | Grossman | |
| 6,000,699 | A | 12/1999 | Long | |
| 6,012,719 | A | 1/2000 | Webb | |
| 6,019,368 | A * | 2/2000 | Sines et al. | 273/149 R |
| 6,019,374 | A | 2/2000 | Breeding et al. | |
| 6,039,650 | A | 3/2000 | Hill | |
| 6,068,258 | A | 5/2000 | Breeding et al. | |
| 6,093,103 | A | 7/2000 | McCrea, Jr. | |
| 6,095,525 | A | 8/2000 | Terminel | |
| 6,113,102 | A | 9/2000 | Marks et al. | |
| 6,117,012 | A | 9/2000 | McCrea, Jr. | |
| 6,126,166 | A | 10/2000 | Lorson et al. | |
| 6,139,014 | A | 10/2000 | Breeding et al. | |
| 6,149,154 | A | 11/2000 | Grauzer et al. | |
| 6,154,131 | A | 11/2000 | Jones, II et al. | |
| 6,158,741 | A | 12/2000 | Koeling | |
| 6,165,069 | A | 12/2000 | Sines et al. | |
| 6,217,447 | B1 | 4/2001 | Lofink et al. | |
| 6,227,969 | B1 | 5/2001 | Yoseloff | |
| 6,250,632 | B1 | 6/2001 | Albrecht | |
| 6,254,096 | B1 | 7/2001 | Grauzer et al. | |
| 6,267,248 | B1 | 7/2001 | Johnson et al. | |
| 6,270,404 | B2 * | 8/2001 | Sines et al. | 463/12 |
| 6,273,424 | B1 | 8/2001 | Breeding | |
| 6,296,251 | B1 | 10/2001 | Webb | |
| 6,299,536 | B1 | 10/2001 | Hill | |
| 6,313,871 | B1 | 11/2001 | Schubert | |
| 6,322,075 | B1 | 11/2001 | DeFranco | |
| 6,325,373 | B1 | 12/2001 | Breeding et al. | |
| 6,334,614 | B1 | 1/2002 | Breeding | |
| 6,341,778 | B1 | 1/2002 | Lee | |
| 6,361,044 | B1 | 3/2002 | Block et al. | |
| 6,371,867 | B1 | 4/2002 | Webb | |
| 6,386,973 | B1 | 5/2002 | Yoseloff | |
| 6,394,456 | B1 | 5/2002 | Long | |
| 6,394,898 | B1 | 5/2002 | Nagao et al. | |
| 6,403,908 | B2 | 6/2002 | Stardust et al. | |
| 6,416,406 | B1 * | 7/2002 | Duhamel | 463/12 |
| 6,450,500 | B1 | 9/2002 | Miller | |
| 6,460,848 | B1 | 10/2002 | Soltys et al. | |
| 6,466,220 | B1 | 10/2002 | Cesana et al. | |
| 6,469,747 | B1 | 10/2002 | Rai et al. | |
| 6,481,718 | B2 | 11/2002 | Koeling | |
| 6,517,435 | B2 | 2/2003 | Soltys et al. | |
| 6,517,436 | B2 | 2/2003 | Soltys et al. | |
| 6,519,283 | B1 | 2/2003 | Cheney et al. | |
| 6,520,857 | B2 | 2/2003 | Soltys et al. | |
| 6,523,829 | B1 | 2/2003 | Walker et al. | |
| 6,527,271 | B2 | 3/2003 | Soltys et al. | |
| 6,530,836 | B2 | 3/2003 | Soltys et al. | |
| 6,530,837 | B2 | 3/2003 | Soltys et al. | |
| 6,532,297 | B1 | 3/2003 | Lindquist | |
| 6,533,276 | B2 | 3/2003 | Soltys et al. | |
| 6,533,662 | B2 | 3/2003 | Soltys et al. | |
| 6,540,230 | B1 | 4/2003 | Walker et al. | |
| 6,568,678 | B2 | 5/2003 | Breeding et al. | |
| 6,579,180 | B2 | 6/2003 | Soltys et al. | |
| 6,579,181 | B2 | 6/2003 | Soltys et al. | |
| 6,588,751 | B1 | 7/2003 | Grauzer et al. | |
| 6,595,857 | B2 | 7/2003 | Soltys et al. | |
| 6,607,443 | B1 * | 8/2003 | Miyamoto et al. | 463/40 |
| 6,629,894 | B1 | 10/2003 | Purton | |
| 6,638,161 | B2 | 10/2003 | Soltys et al. | |
| 6,651,981 | B2 | 11/2003 | Grauzer et al. | |
| 6,651,982 | B2 | 11/2003 | Grauzer et al. | |

6,651,985 B2 * 11/2003 Sines et al. ..... 273/309
6,652,379 B2 11/2003 Soltys et al.
6,655,684 B2 12/2003 Grauzer et al.
6,658,750 B2 12/2003 Scheibner et al.
6,661,425 B1 12/2003 Hiroaki
6,663,490 B2 12/2003 Soltys et al.
6,808,173 B2 * 10/2004 Snow ..... 273/292
6,874,786 B2 * 4/2005 Bruno et al. ..... 273/306
6,960,134 B2 * 11/2005 Hartl et al. ..... 463/20
7,048,629 B2 * 5/2006 Sines et al. ..... 463/16
2002/0169013 A1 11/2002 Serizawa et al.
2003/0199316 A1 10/2003 Miyamoto et al.

* cited by examiner

INTERACTIVE SIMULATED BLACKJACK GAME WITH SIDE BET APPARATUS AND IN METHOD

RELATED APPLICATION DATA

This Application is a continuation-in-part of U.S. patent application Ser. No. 10/272,407, filed Oct. 15, 2002, now U.S. Pat. No. 6,808,173 titled "BLACKJACK GAME WITH SINGLE WAGER ON DISPLAYED CARDS." This Application is also a continuation-in-part of U.S. patent application Ser. Nos. 10/764,827; 10/764,994; and 10/764,995, all filed on Jan. 26, 2004.

BACKGROUND OF THE INVENTION

1. Field of the Invention

The present invention relates to an automated gaming platform, particularly an automated gaming platform that can support multiple players, automated gaming apparatus with a virtual dealt on a multi-player platform, and the implementation of card games, particularly to blackjack card games and its variants and more particularly to an underlying Blackjack card games and variants with side bets on events that do not influence the underlying strategies in the play of the underlying Blackjack game.

2. Background of the Art

In the gaming industry, significant gambling occurs at live table games that use playing cards and a live dealer. Exemplary live table games include blackjack, poker, poker variants such as Let It Ride® stud poker, baccarat, casino war and other games. There are a number of proprietary or specialty live table card games which have developed, such as pai-gow poker, Let-It-Ride® stud poker, Three Card Poker® game, Four Card Poker® game, Caribbean Stud® poker and others. These and many other games all involve play using playing cards. The cards are dealt by a live dealer to the players, to a flop and/or to the dealer. The use of playing cards provided by a live dealer has a number of associated limitations and disadvantages that have long plagued the casino industry. Some of these are of general concern to all or most playing card games. Others are problems associated with the use of playing cards in particular games. Some of the principal concerns and problems are discussed below.

The use of playing cards at live table games typically involves several operational requirements that are time-consuming. These operations are conveniently described as collecting, shuffling, dealing and reading of the cards. In many card games there is also a step of cutting the deck after it has been shuffled. In the collecting operation, a live dealer typically collects the cards just played at the end of a hand of play. This is done in preparation for playing the next hand of cards. The cards must often be collected in the specific order in which they had appeared in the play of the game and must also be collected in a specific orientation, such as all cards being in a facedown or face-up condition. The cards also are typically straightened into a stack with the long sides and short sides aligned. These manipulations take time and are not typically appreciated by either the dealer or players as enhancing the play and entertainment value of the game. The use of physical cards also adds a regular cost to play of the game in the wear on decks of cards that must be replaced every few hours. In many games the cards collected at the end of the hand are deposited in a discard rack that collects the played cards until the time a new stack is obtained or the stack is shuffled. In some games the cards are immediately shuffled into the stack either manually or using a card shuffling machine. More typically, the cards are collected and then shuffling is performed later by the dealer or a shuffling device controlled by the dealer.

When shuffling is needed, it involves a break in the action of the table game and consumes a significant amount of time. Shuffling is also the most time consuming operation in preparing for the next hand. Thus, shuffling is of substantial financial significance to the casino industry because it requires significant time and reduces the number of hands that can be played per hour or other period of time. The earnings of casinos are primarily dependent upon the total number of hands played. This is true because the casino on average wins a certain percent of the amounts wagered, and many or most casinos are open on a 24-hour basis. Thus, earnings are limited by the number of hands that can be played per hour. In light of this there has been a significant and keen interest by casino owners to develop practices that allow more games to be played in a given amount of time. Accomplishing this without detracting from the players' enjoyment and desire to play the game is a challenging and longstanding issue with casino owners and consultants in the gaming industry. The use of high quality shuffling machines, such as those produced by Shuffle Master, Inc. (Las Vegas, Nev.) as shown in U.S. Pat. Nos. 6,655,684; 6,651,982; 6,588,751; 6,658,750; 6,568,678; 6,325,373; 6,254,096; 6,149,154; 6,139,014; 6,068,258; and 5,695,189 have significantly reduced the problem in down time, but there is still the need for a human operator and a human dealer in the use of these shuffling devices for casino table games.

The amount of time consumed by collecting, shuffling and dealing is also of significance in private card games because it also delays action and requires some special effort to perform. In private games there is also some added complexity due to card players remembering or figuring out which player had previously dealt and who should now shuffle and re-deal the cards as needed.

In addition to the time delay and added activity needed to collect, shuffle and deal cards, there is typically some time devoted to cutting the deck of cards which have been shuffled and which are soon to be dealt. This traditional maneuver helps to reduce the risk that the dealer who has shuffled the cards may have done so in a way that stacks the deck in an ordered fashion that may favor the dealer or someone else playing the game. Although cutting the deck does not require a large amount of time, it does take some time. The amount of time spent on cutting also somewhat reduces the frequency at which hands of the card game can be played and introduces another physical step in which human error or design can be introduced, such as dropping and exposing the cards or cutting the deck in a specific position to control the outcome in a fixed deck.

In the gaming industry there is also a very significant amount of time and effort devoted to security issues that relate to play of the casino games. Part of the security concerns stem from frequent attempts to cheat during play of the games. Attempts to cheat are made by players, dealers, or more significantly by dealers and players in collusion. This cheating seeks to affect the outcome of the game in a way that favors the dealer or players who are working together. The amount of cheating in card games is significant to the casino industry and constitutes a major security problem that has large associated losses. The costs of efforts to deter or prevent cheating are very large and made on a daily basis. Many of the attempts to cheat in the play of live table card games involve some aspect of dealer or player manipulation of cards during collection, shuffling, cutting or dealing of cards. Thus, there is a need for methods and apparatus that can be used in the play of live table card games that reduce the ability of the dealer and/or players to cheat by manipulation of playing cards. Of greatest concern are schemes whereby the deck is stacked and the stacked deck is used to the collusive player's advantage. Stacked decks represent huge potential losses since the player is aware of the cards which will be played before play occurs and can optimize winnings by increasing bets for winning hands and decreasing bets for losing hands. It is also desirable to provide decks or groups of cards where card counters are disadvantaged because of the reduction in their ability to track distributions of cards in the group of cards used for play. Continuous shufflers, in which cards are reintroduced into the group of cards being used, the introduction being random throughout the entire group, helps to eliminate that aspect of improper behavior at the gaming table.

Casinos have recognized that their efforts to reduce cheating would be improved if the casino had comprehensive information on the cards which have been played, the amounts bet, the players and dealers involved and other information about actions which have taken place at the card tables. This is of particular importance in assessing the use of stacked decks. It is also important where card tracking is occurring. Additional explanation about card tracking is discussed below. The information desired by the casinos includes knowing the sequence and exact cards being dealt. It would be even more advantageous to the casino if physical cards and live dealers could be eliminated, as this would remove almost all major existing methods of fraud from casino table card games.

Some attempts have been made to record card game action. The best current technology involves cameras that are mounted above the tables to record the action of the card games. This approach is disadvantaged by the fact that not all cards dealt are easily imaged from a camera position above the table because some or all of the cards are not dealt face-up, or are hidden by overlying cards. Although many blackjack games are sufficiently revealing to later determine the order of dealt cards, others are not. Other card games, such as poker, have hands that are not revealed. The covered cards of the players do not allow the order of dealt cards to be ascertained from an above-table camera or on table cameras, as exemplified by U.S. Pat. No. 6,313,871 (Schubert); U.S. Pat. No. 5,781,647 (Fishbine); and numerous patents assigned to MindPlay LLC (e.g., U.S. Pat. Nos. 6,663,490; 6,652,379; 6,638,161; 6,595,857; 6,579,181; 6,579,180; 6,533,662; 6,533,276; 6,530,837; 6,530,836; 6,527,271; 6,520,857; 6,517,436; 6,517,435; and 6,460,848.

Even where cameras are used, their use may not be effective. Such cameras may require time-consuming and tedious human analysis to go over the videotapes or other recordings of table action or require the use of software that is complex and imprecise. In some present systems, some human study may be needed just to ascertain the sequence of cards dealt or to determine the amount of betting or to confirm software determinations from camera read data. Such human analysis is costly and cannot economically be used to routinely monitor all action in a casino card room or table game pit.

For the above reasons, the video camera monitoring techniques have found very limited effectiveness as a routine approach for identifying cheating. There has also been relatively limited use as a serious analytical tool because of the difficulty of analysis. Such camera surveillance techniques are also of only limited effectiveness as a deterrent because many of the people involved with cheating have a working knowledge of their limitations and utilize approaches which are not easily detectible by such systems.

Another use of video camera monitoring and recording has been made in the context of analyzing card table action after someone has become a cheating or card counting suspect. The tape recordings serve as evidence to prove the cheating scheme. However, in the past, this has generally required other evidence to initially reveal the cheating so that careful analysis can be performed. More routine and general screening to detect cheating has remained a difficult and continuing problem for casinos. This is also a human intensive review, with both video monitoring security personnel and live personnel watching the players and apprehending players at the tables.

Another approach to reducing security problems utilizes card shoes having card detection capability. Card shoes hold a stack of cards containing typically from one to eight decks of cards. The cards are held in the card shoe in preparation for dealing and to secure the deck within a device that restricts access to the cards and helps prevent card manipulations. Card shoes can be fit with optical or magnetic sensors that detect the cards as they are being dealt. Some of the problems of security analysis using above-table cameras is reduced when the sequence of cards dealt can be directly determined at the card shoe using optical or magnetic sensors.

One advantage of such card shoes is that the card sequence information can be collected in a machine-readable format by sensing the specific nature (suit and count) of each card as they are dealt out of the card shoe. However, most such card shoes have special requirements for the cards being used. Such cards must carry magnetic coding or are specifically adapted for optical reading. This increases the cost of the cards and may not fully resolve the problems and difficulties in obtaining accurate information concerning sequence information. The automated data collecting card shoes also do not have an inherent means for collecting data on the assignment of the card to a particular player or the dealer. They further do not collect data on the amounts bet. These factors thus require some other manual or partially automated data collection system to be used, or require that time-consuming human analysis be performed using video tapes as explained above.

The use in blackjack of numerous card decks, such as six decks, has been one strategy directed at minimizing the risk of card tracking or counting, especially when the set of cards is cut relatively shallowly so that many cards are not allowed into play from the set. Such tracking should be contrasted with card counting strategies which are typically less accurate and do not pose as substantial a risk of loss to the casino. Use of numerous card decks in a stack along with proper cut card placement can also reduce the risk of effective card counting. However, it has been found that multiple decks are not sufficient to overcome the skilled gambler's ability to track cards and turn the advantage against the house.

Card tracking can be thought of as being of two types. Sequential card tracking involves determination of the specific ordering of the card deck or decks being dealt. This can be determined or closely estimated for runs of cards, sequences of cards forming a portion or portions of a stack. Sequential card tracking can be devastating to a casino since a player taking advantage of such information can bet large in a winning situation and change the odds in favor of the player and against the casino.

Slug tracking involves determining runs of the deck or stack that show a higher frequency of certain important cards. For example, in the play of blackjack there are a relatively large number of 10-count cards. These 10-count cards are significant in producing winning blackjack hands or 20-count hands that are also frequently winning hands. Gamblers who are proficient in tracking slugs containing large numbers of 10-count cards can gain an advantage over the house and win in blackjack.

There is also a long-standing problem in the play of blackjack which concerns the situation when the dealer receives a blackjack hand in the initial two cards dealt. If the dealer has a 10-count card or ace as the up card, then it is possible for the dealer to have a blackjack. If the dealer does have a blackjack, then there is no reason to play the hand out since the outcome of the hand is already determined without further dealing. If the hand is fully played out, and the dealer then reveals that the dealer has received a blackjack hand, then a significant amount of time has been wasted. It also causes players to often be upset when a hand is played out to no avail. In many casinos the waste of time associated with playing out hands with a winning dealer blackjack has lead to various approaches that attempt to end the hand after the initial deal. Some of these allow the dealer to look at the down card to make a determination whether a blackjack hand has been dealt to the dealer. This looking is commonly called "peeking" and is an operation that has been the source of numerous cheating schemes involving dealers and players who work in collusion. In such cheating associated with peeking at the down card, the dealer cheats in collaboration with an accomplice-player. This cheating is frequently accomplished when the dealer signals the accomplice using eye movements, hand movements or other signals. If a dealer does not peek, then he does not know the value of his hand until after the players have completed their play. If the dealer does peek, then he can use such eye movements, hand movements or other techniques to convey instructions to his accomplice-player. These signals tell the accomplice what hand the dealer has been dealt. With this knowledge of the dealer's hand, the accomplice has improved odds of winning and this can be sufficient to turn the long-term odds in favor of the accomplice-player and against the casino. Many casinos do not allow the dealer to look at or inspect the down card until all insurance wagers have been made or declined.

There have also been a substantial number of apparatuses devised to facilitate the peeking procedure or render it less subject to abuse. Such peeking devices are intended to allow determination of whether the dealer has received a blackjack hand; however, this is done without revealing to the dealer what the down card is unless it makes a blackjack. Some of these devices require a special table with a peeking device installed in the table. Others allow the down card to be reviewed using a tabletop device in which the card is inserted. These systems and others involve the use of special playing cards. These devices and methods generally add greater costs and slow the play of the game. The slowed play often occurs to such a degree that it offsets the original purpose of saving the time associated with playing out possible dealer blackjack hands. The prior attempts have often ended up unacceptable and are removed.

Another notable problem suffered by live table games is the intimidation which many novice or less experienced players feel when playing such games. Surveys have indicated that many new or less experienced people who come to a casino are inclined to play slot machines and video card games. These people feel intimidation at a live table game because such games require quick thinking and decision making while other people are watching and waiting. This intimidation factor reduces participation in table games.

A further issue that has developed in the casino business is the public's increasing interest in participating in games that have a very large potential payoff. This may be in part a result of the large amount of publicity surrounding the state operated lotteries. News of huge payoffs is read with keen interest and creates expectations that gaming establishments should provide games with large jackpots. One approach has been the networked or progressive slot machines that use a centralized pool of funds contributed by numerous players. These slot machine systems are relatively more costly to purchase and operate. For many gamblers, this approach is not particularly attractive. This lack of attractiveness may be due to the impersonal and solitary nature of playing slot machines. It may alternatively be for other reasons. Whatever the reason, the public is clearly interested in participating in games that can offer potential jackpots that are very large. Table card games have not been able to satisfactorily address this interest. The continued diminishment in the percent of people who play live table games indicates the need for more attractive games and game systems that address to public's interests.

Further problems associated with live table card games are the costs associated with purchasing, handling and disposal of paper and plastic playing cards. Casinos pay relatively favorable prices for card decks, but the decks roughly cost about $1 per deck at this time. Each casino uses decks for a very limited period of time, typically only one shift, and almost always less than one day. After this relatively brief life in the limelight, the decks are disposed of in a suitable manner. In some cases they can be sold as souvenirs. This is done after the cards are specially marked or portions are punched out to show they have been decommissioned from a casino. This special marking allows the cards to be sold as souvenirs while reducing the risk that they will later be used at the card tables in a cheating scheme which involves slipping a winning card into play at an appropriate point. In other cases the playing cards are simply destroyed or recycled to eliminate this last risk. In any case, the cost of playing cards for a casino is significant and can easily run in the hundreds of thousands of dollars per year.

In addition to the above problems, there are also significant costs associated with handling and storing the new and worn playing cards. Sizable rooms located in the casino complexes are needed just to store the cards as they are coming and going. Thus, the high costs of casino facilities further exacerbate the costs associated with paper and plastic playing cards.

The most significant cost in operation of gaming apparatus is personnel costs. A number of attempts have been made to reduce time requirements for not only the dealers, relief dealers, but also for the supervisors, managers, security and the other staff that are directly or indirectly involved in the operation or maintenance of the games.

A number of attempts have been made to design and provide fully automated gaming machines that duplicate play of casino table card games. These attempts have ranged from and included the highly successful video poker slot games to the mildly successful slot-type blackjack game (for single players). In those systems, the individual player sits at an individual machine, inserts credits/currency/coins, and plays a one-on-one game that is controlled by a processor in the machine or to which the machine is distally connected (networked). These machines are common in casinos, but do not duplicate the ambience of the casino table game with multiple players present.

Another type of attempt for simulating casino table card games is the use of a bank of individual player positions associated with a single dealer position in an attempt to simulate the physical ambiance of a live casino table card game. Such systems are shown in U.S. Pat. No. 4,397,509 (Miller); U.S. Pat. No. 4,614,342 (Takashima); U.S. Pat. No. 4,995,615 (Cheng); U.S. Pat. No. 5,470,080 (Naku); and Published U.S. Patent Applications 2002/0169013 (Serizawa); 2003/0199316 (Miyamoto); and the like. These systems have a video display of a dealer and have individual monitors for display of the players' hands and the dealer hands. The architecture of these systems has generally been designed on a unique basis for each game, and there tends to be a main computer/processor that drives all elements of the game, or two computers/processors that distribute the video control of the dealer image and the remainder of the game elements between the two distinct computer/processors. This tends to maximize the cost of the system and tends to provide a slow system with high processing power demands to keep the operation working at speeds needed to maximize use and profit from the machines.

Sines, U.S. Pat. Nos. 6,651,985 and 6,270,404 are titled "Automated system for playing live casino table games having tabletop changeable playing card displays and play monitoring security features". Sines U.S. Pat. No. 6,165,069 is similarly titled "Automated system for playing live casino table games having tabletop changeable playing card displays and monitoring security features."

The latter two patents (6,270,404 and 6,165,069) are related as continuations and therefore have identical disclosures. U.S. Pat. No. 6,651,985 claims continuation-in-part status from the earliest application (U.S. Pat. No. 6,165,069).

Sines, U.S. Pat. No. 6,651,985, describes the use of a live dealer, even though virtual cards are used. There is no virtual dealer display and no software or architecture controls needed for a virtual dealer display. There are distinct display components for the players' hands and dealer's hand. Looking at FIGS. 23, 24 and 25 (which are identical to the same figures in U.S. Pat. No. 6,651,895, discussed above), it appears that at least for betting functions, the system operates with parallel communication to the player input stations. (See wire connections shown in FIGS. 24 and 25 to the Player Bet Interfaces 196, 198, 201 and 203.)

U.S. Pat. No. 6,607,443 (Miyamoto et al., Kabushiki Kaisha SEGA Enterprises) and Published U.S. Application 2003/0199316 A1 (also KKSE) and particularly FIGS. 1, 2, 3, 7, 9, 10, 11, 12 and 13, discloses a virtual blackjack table system. The main objective of this patent is to have optical data that enables the SEGA system to read hand signals of players, such as calls for hits and Stand signals. The hardware architecture in FIG. 15, as described in the specification at column 11, lines 29-54 show that there are distinct CPU's for the (audio and video, 280, 281, 282, 283) which is driven by the Sub-CPU, which is turn connected to the main CPU (201), with an additional sub-CPU 204 directing the motion sensor system 13, 14, 15, 16, and 32. There are distinct processing blocks for the sound (22), the video (21), the main CPU (20), and the subsystems (13), as well as the components already noted for the motion sensors/facial recognition sensors system.

U.S. Pat. No. 5,221,083 (Dote, SEGA Enterprises, Ltd.) describes a blackjack automated game system that has a reflected video image of a dealer and also has individual satellite player positions, with individual CRT monitors for each player. There is no disclosure of the type of information processing hardware in the system.

U.S. Pat. No. 5,934,998 (Forte and Sines, unassigned) and U.S. Pat. No. 5,586,766 (Forte and Sines, assigned to Casinovations, Inc.) describe a system using physical cards and a physical dealer, with no dealer display, on a blackjack table that has a CPU. FIGS. 6-10 show circuit construction and hardware considerations in the design of the system, including communication architecture. This system provides a count display (e.g., LED display) at each player position to show the player count and dealer count (as appropriate) that is determined from reading of the physical cards. Physical playing chips are also used; with no credit wagering capability is shown.

U.S. Pat. No. 5,159,549 describes a system that provides a multiple player game data processing unit with wager accounting. There are distinct player stations with player input on wagering. There may be a limited amount of intelligence at player stations (see column 4, line 1 through column 7, line 55), but there are multiple lines to each player station.

U.S. Pat. No. 4,614,342 (Takashima) describes an electronic game machine with distinct display units (CRT screens) at the player positions and the dealer position. The dealer screen (10) does not show an image of a dealer, but shows the dealer's card(s) and game information. There are typical player input controls (16) at each player position. The system provided is more like a bank of slot systems than a card table. In addition to a dealer data processor (6), each player position includes a player data processor CPU (30) with player memory (32). The central dealer computer apparently polls the individual player data processors to obtain the status of the events at each position (column 4, lines 1-60; and column 3, lines 8-17).

U.S. Pat. No. 5,586,936 (Bennett et al., assigned to Mikohn Gaming) describes a ticketless control system for monitoring player activity at a table game, such as blackjack. Physical cards and physical chips are shown. Player identity cards identify each player entering play at a table, and a separate ticket printer issues a results ticket (500) at the end of play or reads the ticket at the beginning of play. There is no distinct intelligence apparent at each player position, and there is a central CPU that controls the system (e.g., FIG. 8). Physical chips and a real dealer are apparently used. A phone line (630) is connected from each player position to the CPU (820) through a communications port (814).

U.S. Pat. No. 4,995,615 (Cheng) describes a method and apparatus for performing fair card play. There are individual player positions with individual screens (12) provided for each player. There are three vertical, card-display screens (11, 13, 11) shown for "receiving instructions from the computer to display sequentially the cards being distributed throughout the processing of the play . . . " (Column 4, lines 4-13). There is no visual display of a dealer, there are individual player image panels, and no details of the architecture are shown or described.

U.S. Pat. Nos. 5,879,235; 5,976,019; and 6,394,898, assigned to SEGA Enterprises, Ltd. relate to non-card game systems, such as horse race simulators or ball game simulators (e.g., roulette). There is no dealer or croupier simulation. The horse race simulator is an automated miniature track with physically moving game elements. The point of interest is in evaluating the architecture to see how the intelligence is distributed between the player stations and the wagering screen. The system again shows individual monitors at each player position (80, 81) and no dealer display. The schematics of the electrical architecture in FIG. 11 shows a main board that also includes a Picture Control Section (95), Sound Control Section (96), and a communication control section (107). There is a distinct picture output board (108).

U.S. Pat. No. 6,607,443 (Miyamoto et al., Kabushiki Kaisha Sega Enterprises) shows an automated gaming table device in which there is an upright screen that displays a dealer's image. The particular purpose described in this patent is for recognition of sound and hand movement by players, but there is some description of the dealer screen display. For example, Column 7, line 45 through column 9, line 8 describes the images of the dealer provided on the main central screen 7 during game play. There is disclosure to the effect that a dealer's image and particular expressions and body position are provided (along with sound) of the dealer. There are no details at all with respect to the background, the combination of images or the like.

U.S. Pat. No. 5,221,083 (Dote, Sega Enterprises, Ltd.) shows an automated gaming machine with a vertical image of a dealer presented to players sitting at a kiosk-type counsel. The screen or upright portion 2 has an image of a dealer 4 on a background or georama 13 that is formed on the inner surface of the upright portion 2. There are physical elements (e.g., pillars 14) that may be located in recesses in the upright portion 2 in front of the image to emphasize three-dimensionality. The table 5 is disposed in front of the pillars 14 and the image of the dealer 4 behind the pillars 14. The georama 13 is a physical image or construction, and the image of the dealer is originated in a CRT (e.g., 17) lying with the screen horizontal, and the image from the CRT17 is reflected from a 45 degree mirror 20 for display to the players. This gives the illusion of the dealer being between the table and the georama background. The georama is a physical element, and has no video background at all. The dealer image is a reflected image, not a direct image. The reference appears to describe a distinct dealer image set against a backdrop of a scene.

It must be remembered that the technology of combining video images is standard commercial technology and is relatively old technology from the 1970's. Although many different backing colors may usefully be employed under special conditions, the most commonly selected backing color is substantially pure blue. Therefore, for clarity of description a blue backing will generally be assumed in the present discussion, and the process will ordinarily be referred to by the customary term, "blue screen process." However, any such simplifying assumptions and terminology, are not intended to imply that other colors may not be used, with corresponding modification of the procedure. For example, U.S. Pat. No. 3,595,987, entitled "Electronic Composite Photography" describes apparatus and operations that can be used in creating such combined video images.

U.S. Pat. No. 4,007,487 (Vlahos, Motion Picture Academy of America) describes an improved electronic compositing procedure and apparatus. The process is typically used in the blue screen process and it is suitable for processing motion pictures of professional quality and the like. The invention provides compensation for color impurity in the backing illumination over a continuous range of effective transparencies of the foreground scene. Applicant's previous method for limiting the blue video component for the foreground scene to permit reproduction of light blue foreground objects is improved by a dual limitation criterion which simultaneously suppresses blue flare light from the backing reflected by foreground objects of selected colors, typically including grey scale and flesh tones. The control signal for attenuating the background scene is developed as a difference function predominantly only at areas occupied by opaque or partially transparent foreground objects, and is developed predominantly as a ratio function at unobstructed backing areas, thereby compensating undesired variations in brightness of the backing illumination, while permitting desired shadows on the backing to be reproduced in the composite picture. This is an overlay imaging process for video imaging.

U.S. Pat. No. 4,100,569 (Vlahos) discloses an electronic circuit for combining foreground and background pictures substantially linearly, and included special arrangements for accommodating objects including both blue and magenta colors in the foreground. The system as described merges of foreground and background pictures through a wide range of transparency of the foreground objects. In addition to the normal type of transparent foreground images, including smoke, glasses, and the like, the edges of moving objects are shown as being partially transparent to provide the illusion of rapid movement.

U.S. Pat. No. 4,344,085 (Vlahos, Vlahos-Gottschalk Research) describes a blue screen imaging compositing process using a clean-up circuit that eliminates problems caused by footprints, dust, and dirt on the "blue-screen" floor or other single color backing for the foreground scene, by modifying the basic linear background control signal by using a dual control signal. The normal linear control signal operates over the entire picture in the normal manner. The second control signal is generated by amplifying the linear control signal and inserting it back into the control circuits via a linear OR gate. Thus, any selected level of the background control signal $E_c$ below 100 percent may be raised to 100 percent without influencing the lower levels of $E_c$. At a background control voltage level of perhaps 80 percent or 90 percent of the full background picture intensity, it may be abruptly increased to 100 percent. Above this selected level, any semi-transparency object, (for example the undesired footprint) is made fully transparent and is not reproduced. Further, while the foregoing signals are reduced to zero at this point, the background scene turn-on signal is raised to full intensity levels. This has the interesting collateral effect that thin wires that may be employed to support foreground objects may be rendered invisible, along with the undesired footprints and dust. There is no disclosure of its use for Video Gaming.

U.S. Pat. No. 6,661,425 describes a method for overlapping images in a display. An information input/output device has an intuitive operating feeling and improved information viewing and discriminating properties. The device comprises an superposing image extraction unit extracting a portion for super positional display from an image to output the extracted image portion as an superposing image, a mask pattern generating unit generating a mask pattern, effectors processing the superposing image, and the mask pattern based on the effect designation information, and a base image generating unit synthesizing the mask pattern image and the original image to generate a base image. The device also comprises a switcher, brightness/contrast controllers adjusting the brightness or contrast of the display image switching means, a control unit, super positional image display unit for superposed demonstration of display image planes of the displays and a display position adjustment mechanism. The display information of the image for display in superposition is demonstrated at a position that appears to be floated or recessed from the basic display plane.

U.S. Pat. No. 6,469,747 describes a video signal mixer with a parabolic signal mixing function, especially useful in scene-by-scene color correction systems and "blue screen"

video masking applications. The mixer effects mixing two independent signal sources while smoothly controlling the rate of change during mixing. An input stage receives a first video signal and a second video signal. The mixing circuit mixes the first video signal with the second video signal based on a predetermined parabolic function. An aperture signal circuit in the mixer allows a degree of operator control over the parabolic function. An output stage provides a parabolized output signal. The output signal, which comprises the mixture of the first video signal and the second video signal, eliminates discontinuities in regions of the signal which would otherwise produce discontinuities in prior art types of video signal mixers. There is no specific description of the combining of live images on the screen with a preprogrammed image.

There are many wagering games used for gambling. Such games should be exciting to arouse players' interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolutions is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by of a predetermined arrangement of cards in the player's hand. U.S. Pat. No. 4,836,553 (to Suttle and Jones) discloses a modified version of a five card stud poker game.

In addition to novel games being introduced into casinos, novel betting formats have also been introduced. Side bets have always been common in wagering environments, but the use of side bets for jackpots and bonuses in casino table card games was believed to have been first practiced by David Sklansky in about 1982 in a public showing of Sklansky's Poker in Las Vegas, Nev. The play and/or betting structure of Caribbean Stud Poker® was modeled after that game. Blackjack has allowed surrender play at many tables, where half the original wager is withdrawn and the other half is forfeited to the house at the election of the player. U.S. Pat. No. 5,820,460 (Fulton) describes a method for playing a casino table card game wherein wagers are changed after some cards are viewed by the player. Let It Ride® stud poker advanced that theory significantly as described in U.S. Pat. No. 6,273,424, where specific segments of wagers could be withdrawn from an original wager that was made in multiple parts.

In an attempt to accommodate the desire for variety and the retention of a significant table game presence, several Blackjack variant games and baccarat variant games have been introduced. These games include Mini-Baccarat, progressive win side bets in Baccarat, Multiple Action Blackjack, Spanish 21, Over/Under 13, Face-Up 21, and Royal Match. See, e.g., U.S. Pat. No. 5,673,917 to Vancura. A summary of known Blackjack variants is discussed in the Vancura patent.

The addition of side bet wagers to table games has provided an additional level of excitement and a chance for increased awards to be made in table games. The side bet in Over/Under 13 is limited to a one-to-one payout, so again, large payouts are provided with only large wagers. Such games as Minnesota 21™ provide higher bonuses (e.g., as much as $500 on a one dollar side bet for three consecutive blackjacks) with a side bet or house take based on the level of the underlying wagers. Other payouts that are multiples of the house take are based on hands of 6-7-8, blackjacks in suit, and the like.

U.S. Pat. No. 6,296,251 describes a baccarat or blackjack game with a payout that is a multiple of the initial wager (there is no side bet or additional wager beyond the wager on the underlying game). The broadest concept of the game described is as a method of playing a casino card game that is based on card hand numerical totals (e.g., blackjack and baccarat) and includes a player core wager, the core wager being the only wager required for the player to participate in the game. The method comprises establishing a dealer hand having a numerical total and a player hand having a numerical total; and paying a variable payoff according to the player core wager that varies according to an amount of numerical difference between the dealer hand numerical total and the player hand numerical total. A typical pay table for blackjack is described as

| Player Wins By | Payoff |
|---|---|
| 4 | 4 to 1 |
| 3 | 3 to 1 |
| 2 | 2 to 1 |
| 1 | 1 to 1 |

Attempts have been made to vary the game of Blackjack to a relatively minor degree wherein a Blackjack player could have more than one betting option other than the Blackjack player's bet to receive a higher card total not more than the maximum of 21 than the Dealer or to hope that the Dealer busts. However, these other attempts have not been successful because they do not provide a multitude of very exciting betting options combined with a large jackpot type of payout. U.S. Pat. No. 5,454,570 to Karal discloses a Blackjack card game method therein a Blackjack player has extended wagering opportunities after the Blackjack player's hand has reached a desired card count value. Specifically, the Blackjack player can bet on whether the Dealer will achieve a card count that would be higher (but not greater than 21) than the Blackjack player's hand. This supplemental bet or wager by the Blackjack player is prior to the Dealer revealing the Dealer's face down card. Predetermined odds on the different possible Dealer hand combinations are selected by the Blackjack player by the selection of the point card value of the Dealer's hand. Also, the Blackjack player can wager on the point card value of the Dealer's only face down card. Furthermore, the Blackjack player can bet on the point card value of the third Dealer card, etc. The odds presented in this U.S. Patent range from 10 to 1 (on an Ace being the Dealer down card or the next card to be drawn by the Dealer). Picture cards including 10's have a 2 to 1 betting ratio.

U.S. Pat. No. 5,275,416 to Schorr et al. also discloses a Blackjack card game method wherein a Blackjack player can bet on the Dealer's hand, the Blackjack player's hand or for a tie in the point count between the Dealer and the Blackjack player. The bet for the tie pays 9 to 1, the bet for the Blackjack player's hand is even money (1 for 1), and the bet on the Dealer's hand is 5 for 6 (five chips can be won on a 6 chip bet).

U.S. Pat. No. 5,174,579 to Griffiths discloses a Blackjack card game method wherein a separate bet can be made on whether the dealer obtains exactly 21 or busts. Disclosed therein is a discussion of Royal Match 21 involving a separate bet by the Blackjack player to have their 2 initial cards be of the same suit (i.e. clubs, diamonds, hearts and spades). A higher payout is made when the Ace and King is received by the Blackjack player in the same suit for the 2 initial cards, but there is no separate bet for the receipt of these two cards (only a payout if they happen to be received when a bet is made for the receipt of 2 initial cards of the same suit). Also disclosed therein is a reference to the U.S. Pat. No. 4,861,041 to Jones et al. wherein a separate bet on a blackjack game is made to be eligible for certain specific jackpot hands (i.e., four 5's and an Ace or Ace, Two, Three, Four, Five and Six). Simply stated, prior attempts at providing more than one betting option to the Blackjack player did not give the Blackjack player an opportunity to bet and win a very large bonus (i.e. more than a thousand chips for each chip bet) as well as to bet on many different possible combinations that would pay more than a one chip payback for each one chip bet, but yet still provide the Blackjack player with, if desired, a straight bet to beat the dealer.

U.S. Pat. No. 5,816,575 describes a variant of Blackjack (21) game, in which a table and method is disclosed wherein a number of betting options are provided for the Blackjack player. In addition to the standard betting option against the dealer, a dealer Bust option, a jackpot option where the Blackjack player can obtain over 1,000 to 1 return payout and several other betting options are provided to bet on various possible cards such as receiving a 3 or a 6, a 4 or 5, a 10, Jack Queen, King or Ace for one or both of the initial two cards. The method of playing Blackjack against a dealer comprises the steps of providing a Blackjack player with a jackpot betting option to make a bet and have a possibility of winning more than one thousand times the bet made by the Blackjack player; and providing the Blackjack player with additional separate betting options to make a bet on receiving at least one card from an initial two cards received by the Blackjack player equal to one of a 4 and 5, one of a 3 and 6 and a selected one of a 10, a Jack, a Queen, a King and an Ace.

U.S. Pat. No. 5,839,730 describes a method for a wagering game including providing a side bet opportunity during the play of a Twenty-One game. The player is given the opportunity to place this side bet with the hope of receiving winnings when certain predetermined card configurations are received. Upon receipt of these defined card configurations, the player is immediately paid winnings during the process of the Twenty-One game. These additional winnings are based on sequences of cards and are independent and separate from wagers in the Twenty-One game. Additionally, all of the predetermined card configurations are preferably chosen such that they will not interfere with the underlying Twenty-One game. As a basis for paying out winnings, it is required that the player consecutively receive these certain card configurations during the play of the Twenty-One game after having made a bet in expectation of those card configurations appearing. Also, the final configuration of the Twenty-One hand is irrelevant to the side bet game as the players win immediately when the predetermined configurations are received, long before completion of the hand. In particular, the player's receiving of identical value cards in sequence is awarded bonus amounts when a side wager is placed.

U.S. Pat. No. 6,012,719 describes a card game that combines the play of Blackjack ("21") with a 3-card Poker wager or side bet ("21+3"). Each player places a basic Blackjack wager and an optional 3-card Poker wager before the cards are dealt. Each player is then dealt a card with the dealer receiving a face-up card. Each player is dealt a second card. At this point, the outcome of each 3-card Poker hand is determined, where a player's 3-card Poker hand consists of the 2-card hand dealt to that player and the dealer's face-up card. After settling the Poker wagers, the game of Blackjack continues in a typical fashion. The invention advantageously retains all the features and advantages of Blackjack as well as provides the dynamics of 3-card Poker, without interfering with the card sequence, for enhanced player anticipation and enjoyment.

D.E.Q. Casinos, Ltd. markets a game known as "Luck Jacks & Queens™" which is played in conjunction with a side bet in a standard blackjack game. Regular blackjack rules apply, and an optional side bet for the side game is made. Combinations of a Jack and a Queen on the first two cards wins a randomly selected prize amount. Suited Queen and Jack combinations on the first two cards can win multiples of the randomly selected prize amounts. The random amount is selected and displayed on a meter attached to the table. There is no pay table.

It is desirable to design and provide additional games, especially baccarat games, that provide good profits for the house and more betting opportunities, while providing players with more exciting play, more variety in play, and an opportunity to obtain greater payouts, especially payouts in excess of 5:1.

SUMMARY OF THE INVENTION

A multi-player automated casino table card game platform enables play of casino table blackjack-type games according to rules effected through a processor. An underlying game of Blackjack or a variant of Blackjack is played with an initial wager by a player on the underlying game and an optional wager that can be made on a side game. The side wager is made before any cards are displayed. The side wager is made on whether a specific rank of card will be shown in either of the two player's cards (the player who has made the wager) or in the dealer's exposed card. The probabilities of a specific rank of a card (as opposed to value of card, which would render 10's, Jacks, Queens and Kings equivalent) is the same, whichever card is selected, but a preferred game from an advertising standpoint, marketing standpoint or the like is the use of Jacks, with the game titled Jack Magic™ blackjack or. The player places a side wager on an identified wager area, and after the player's cards and the dealer's cards have been dealt, the side wager is resolved according to the rules of the game. In one embodiment, all cards of a specific rank, i.e., Jacks, are winning side bet hands. The regular play of the Blackjack game is then continued, with no change in the underlying strategy of the game. The Jack Magic™ blackjack game may be played with certain tolerable variations. For example, when a player splits a hand (with or without any Jacks displayed in the player's hand or the dealer's hand), the house rules may control whether the play of Jack Magic™ blackjack continues, or whether the side bet is cancelled with only the first two cards displayed. The Jack Magic™ blackjack game may also be played where only the first card dealt with a split may be active in the side bet game. These variations significantly affect the payouts, the hold, and the odds in the game, so with each variation in the rules, different odds and different payout tables would have to be provided. The preferred method of play would be for the Jack Magic™ game being played on only the first two exposed cards dealt to the player and the dealer's single exposed card.

DETAILED DESCRIPTION OF THE INVENTION

Figure 1:
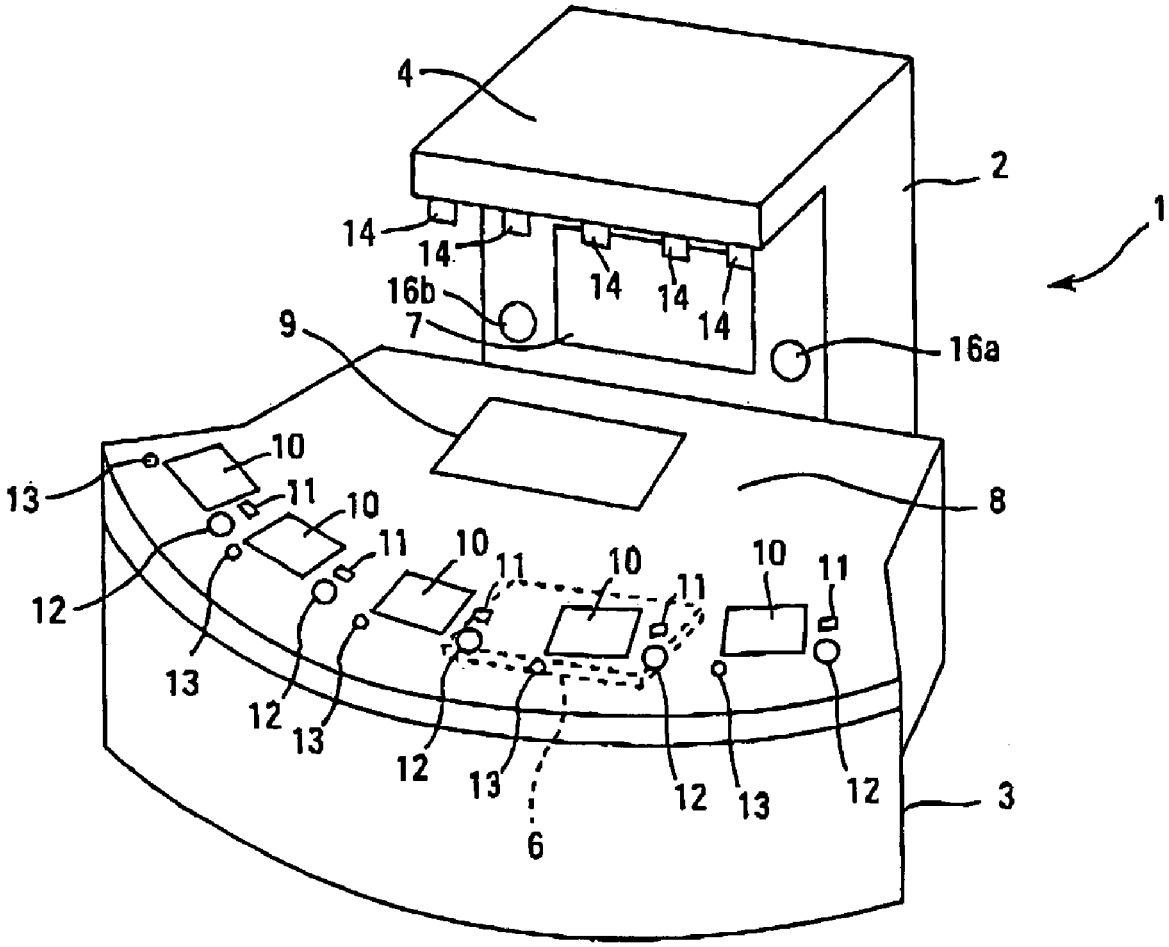
Fig. 1 Prior Art
FIG. 1 shows a perspective view of a prior art format for an automated gaming system.

The games of the present invention may be implemented as live table games, television or cable game show games, video poker gaming machine platforms, hand-held games for play, multiple player interactive wagering platform games (with kiosk formats, single player screens, community screens, and/or banks of seats for players with a common dealer screen), cell phone games, games downloadable from the internet, parlor games, games executed on personal computers, palm pilots, play stations and the like. Each of the above game applications is contemplated by the present invention.

Apparatus is disclosed for playing the wagering game according to the method outlined below. A typical gaming table, with a playing surface, is modified to include specific areas that provide locations for placing the wagers and for displaying player and dealer cards. A card shuffling machine such as that disclosed in U.S. Pat. No. 4,807,884 or other shuffling machines manufactured by Shuffle Master Gaming, Inc. of Las Vegas, Nev. may be used for facilitating and speeding the play of the live version of the wagering game. A display device may be associated with the apparatus for displaying game information, shuffle status, or other information relevant to the dealer, the players or the house.

Still another aspect of the present invention is to provide a wagering game that is easy to learn, yet demands skill of players in making strategic decisions about whether to take additional hot cards, whether to split cards, double down, make insurance wagers and place a side bet. It is an advantage of the game of the present invention that wagering decisions are inherent in the game. The game enhances players' sense of participation and takes advantage of players' inclination to keep wagers at risk once placed. The interdependency of at least two bets further encourages players to let bets remain at risk.

A gaming system that can be used to practice the method of the present invention comprises a table and a dealer "virtual" video display system positioned for view by players seated at the table. The table may seat at least two players up to the amount of players that can be configured about the table and have a view of the dealer video display system. Typically each gaming system will have at least four player available positions, with space determinations considered as to whether there would be 4, 5, 6 or 7 player positions. It is possible to have a completely circular dealer display (e.g., holographic display in a cylindrical centerpiece) and have players distributed around the entire periphery, but this is too dissimilar to standard play arrangements and could slow the game down, as play should approximate that of a live game, with players sitting together and playing in sequence. A surface of the table will include a generally continuous display screen on the surface for showing all player hands, community cards, dealer hands and any other cards used to play the game for any purpose, and, touch screen player controls or move conventional push-button controls. A majority of the table surface comprises a video monitor in one example of the invention. Where there are no touch screen controls, the table surface may include player control panels at each player station near the continuous display screen. The use of a continuous display screen offers some significant advantages in simulating or recreating a standard card table surface. Cards may be readily viewed by other players at a table, which is standard in table games and adds to player enjoyment. Individual monitors, especially where slanted towards the individual players make such table-wide card reading difficult. The use of the full screen (continuous) display also allows for better animation to be provided, such as displaying virtual images of cards moving to the player and "virtual" chips being placed on the table when wagers are indicated. For purposes of this disclosure, the term "virtual" means a graphical video representation of a real object or person, such as a dealer, cards and chips, for example.

The individual player positions preferably have a separate intelligence at each player position that accepts player input and communicates directly with a game engine (main game computer or processor). The intelligence is preferably an intelligent board that can process information. For purposes of this disclosure the term "intelligent" refers to the ability to execute code, either provided in the form of software or hardware circuits. Such processing may at least comprise some of signal converting (e.g., signals from player card readers, credit deposit, currency readers, coin readers, touch screen signals, control panel signals) into a signal that can be included in an information packet and interpreted by the main game computer when the signal is sent. Communication between the intelligence at each player position is direct to the main game computer and may be by self-initiated signal sending, sequenced polling by the main game computer (e.g., each position communicates directly to the main game computer in turn), timed communication, or any other order of communication that is direct between the intelligence and the main game computer.

One preferred form of communication between the main game computer and player station computers is by means of self-initiated signal sending. There is essentially a single main game computer that contains video display controls and programs for both the dealer display and the table top display, audio controls and programs, game rules (including storage of multiple games if intended to be available on the machine), random number generator, graphic images, game sequence controls, security systems, wager accounting programs, external signaling and audit functions, and the like. In other forms of the invention, the above functions are divided between a main processor and one or more additional processors. The intelligence at each player position speeds up the performance of all aspects of the game by being able to communicate directly with the main game computer and being able to process information at the player position rather than merely forwarding the information in raw form to the main game computer. Processing player information at player positions frees up resources for use by the main processor or processors.

A card game system may also include a suitable data and control processing subsystem that is largely contained within a main control module supported beneath the tabletop. The control and data processing subsystem includes a suitable power supply for converting alternating current from the power main as controlled by a main power switch. The power supply transforms the alternating line current to a suitable voltage and to a direct current supply. Power is supplied to a power distribution and sensor/activity electronics control circuit. Commercially available power switching and control circuits may be provided in the form of a circuit board which is detachable, and plugs into a board receptacle of a computer mother board or an expansion slot board receptacle. A main game controller motherboard may include a central microprocessor and related components well-known in the industry as computers using Intel brand Pentium® microprocessors and related memory or intelligence from any other manufacturing source. A variety of different configurations and types of memory devices can be connected to the motherboard as is well known in the art. Of particular interest is the inclusion of two flat panel display control boards connected in expansion slots of the motherboard. Display control boards are each capable of controlling the images displayed for the dealer video display and for each of the player position display areas on the continuous display screen on the table and other operational parameters of the video displays used in the gaming system. More specifically, the display control boards are connected to player bet interfaces circuits for the player stations. This arrangement also allows the display control boards to provide necessary image display data to the display electronic drive circuits associated with the dealing event program displays and the dealer display.

The motherboard and/or the individual player intelligent boards also includes a serial port that allows stored data to be downloaded from the motherboard to a central casino computer or other additional storage device. In one example, each player board communicates directly with the casino computer system. This allows card game action data to be analyzed in various ways using added detail, or by providing integration with data from multiple tables so that cheating schemes can be identified and eliminated, and player tracking can be maintained. Player performance and/or skill can be tracked at one table or as a compilation from gaming at multiple tables, as by using Bloodhound™ security software marketed by Shuffle Master, Inc., which may be incorporated into this automated gaming system. Additionally, player hand analysis can be performed. The motherboard and/or individual player intelligent boards may also have a keyboard connection port that can be used to connect a larger format keyboard to the system to facilitate programming and servicing of the system.

Although the preferred system shown does not require features illustrated for receiving automated player identification information, such features can alternatively be provided. Card readers such as used with credit cards, or other identification code reading devices can be added in the system to allow or require player identification in connection with play of the card game and associated recording of game action by one of the processors. Such a user identification interface, for example a card reader located at each player station, can be implemented in the form of a variety of magnetic card readers commercially available for reading user-specific identification information. The user-specific information can be provided on specially constructed magnetic cards issued by a casino, or magnetically coded credit cards or debit cards frequently used with national credit organizations such as VISA, MASTERCARD, AMERICAN EXPRESS, casino player card registry, banks and other institutions. The information could also be provided on other writable media, such as an RFID chip with writable memory, or bar coding, as just a few examples.

Alternatively, it is possible to use so-called smart cards to provide added processing or data storage functions in addition to mere identification data. For example, the user identification could include coding for available credit amounts purchased from a casino. As further example, the identification card or other user-specific instrument may include specially coded data indicating security information such as would allow accessing or identifying stored security information which must be confirmed by the user after scanning the user identification card through a card reader. Such security information might include such things as file access numbers which allow the central processor to access a stored security clearance code which the user must indicate using input options provided on displays using touch screen displays. A still further possibility is to have participant identification using a fingerprint image, eye blood vessel image reader, or other suitable biological information to confirm identity of the user that can be built into the table. Still further it is possible to provide such participant identification information by having the pit personnel manually code in the information in response to the player indicating his or her code name or real name. Such additional identification could also be used to confirm credit use of a smart card or transponder. All or part of the functions dedicated to a particular player station are controlled by the player station intelligence in one form of the invention. Additionally, each player station intelligence may be in communication with a casino accounting system.

It should also be understood that the continuous screen can alternatively be provided with suitable display cowlings or covers that can be used to shield display of card images from viewing by anyone other than the player in games where that is desirable. This shielding can also be effected by having light-orientation elements in the panel, and some of these light-orientation elements are electronically controllable. In this manner, the processor can allow general viewing of cards in games where that is desirable or tolerated, and then alter the screen where desired. These types of features can be provided by nanometer, micrometer or other small particulate or flake elements within a panel on the viewing area that are reoriented by signals from the processor. Alternatively, liquid crystal or photo chromatic displays can be used to create a screening effect that would allow only viewers at specific angles of view from the screen area to view the images of cards. Such an alternative construction may be desired in systems designed for card games different from blackjack, where some or all of the player or dealer cards are not presented for viewing by other participants or onlookers. Such display covers or cowlings can be in various shapes and configurations as needed to prevent viewing access. It may alternatively be acceptable to use a player-controlled switch that allows the display to be momentarily viewed and then turned off. The display can be shielded using a cover or merely by using the player's hands. Still further it is possible to use a touch screen display that would be controlled by touch to turn on and turn off. Similar shielding can be used to prevent others from viewing the display.

A review of the figures will assist in a further understanding of the invention.

FIG. 1 shows a fully automated gaming table 1 of the prior art, as disclosed in U.S. Patent Application 2003/0199316. The system 1 comprises a vertical upright display cabinet 2 and a player bank or station cluster arrangement 3. The vertical display cabinet 2 has a viewing screen 7 on which images of the virtual dealer are displayed. The top 8 of the player bank arrangement 3 has individual monitor screens 10 for each player position, as well and tabletop inserted coin acceptors 11, and player controls 12 and 13. There is a separate and larger dealer's hand screen 9 on which dealer cards are displayed in a format large enough for all players to view. Speakers 16*a* and 16*b* are provided for sound transmission and decorative lights 14 are provided.

Figure 2:
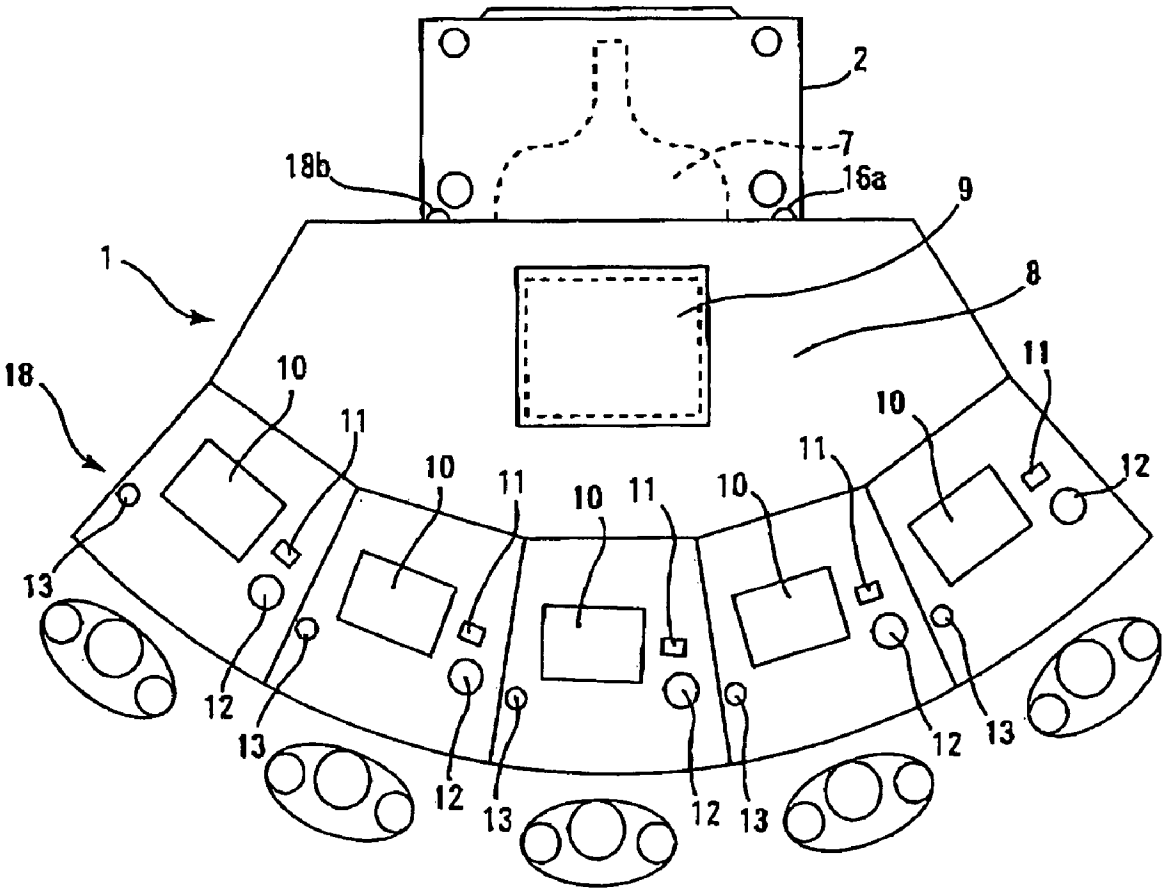
Fig. 2 Prior Art
FIG. 2 shows an overhead view of a prior art format for an automated gaming system.
Figure 3:
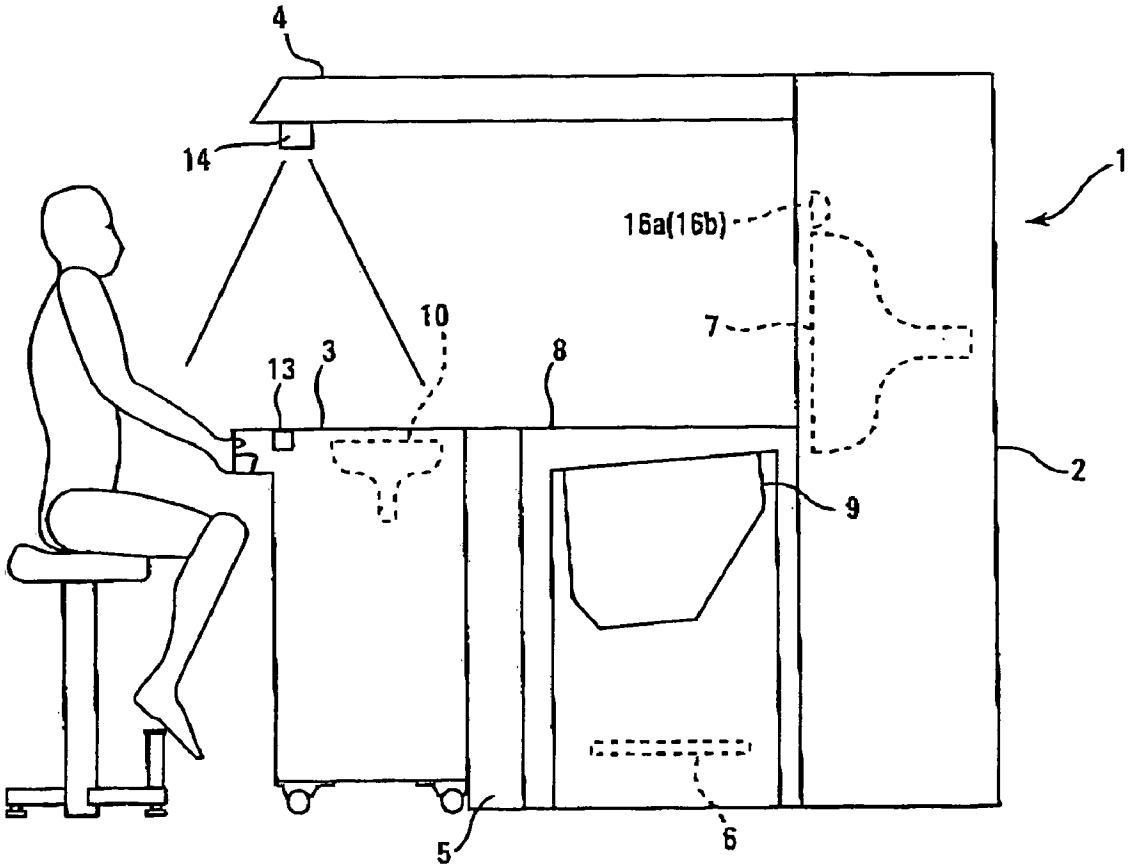
Fig. 3 Prior Art
FIG. 3 shows a side view of a prior art format for an automated gaming system.

FIG. 2 shows an overhead view of the same prior art automated gaming system 1 with the viewing screen 7 shown more clearly as a CRT monitor. It can also be seen that each player position has to form an arc cut into the semicircular player seating area 18. FIG. 3 shows a side view of the same prior art automated gaming system of FIGS. 1 and 2 where the orientation of the three different types of CRT monitors 7, 9 and 10 are shown.

Figure 4:
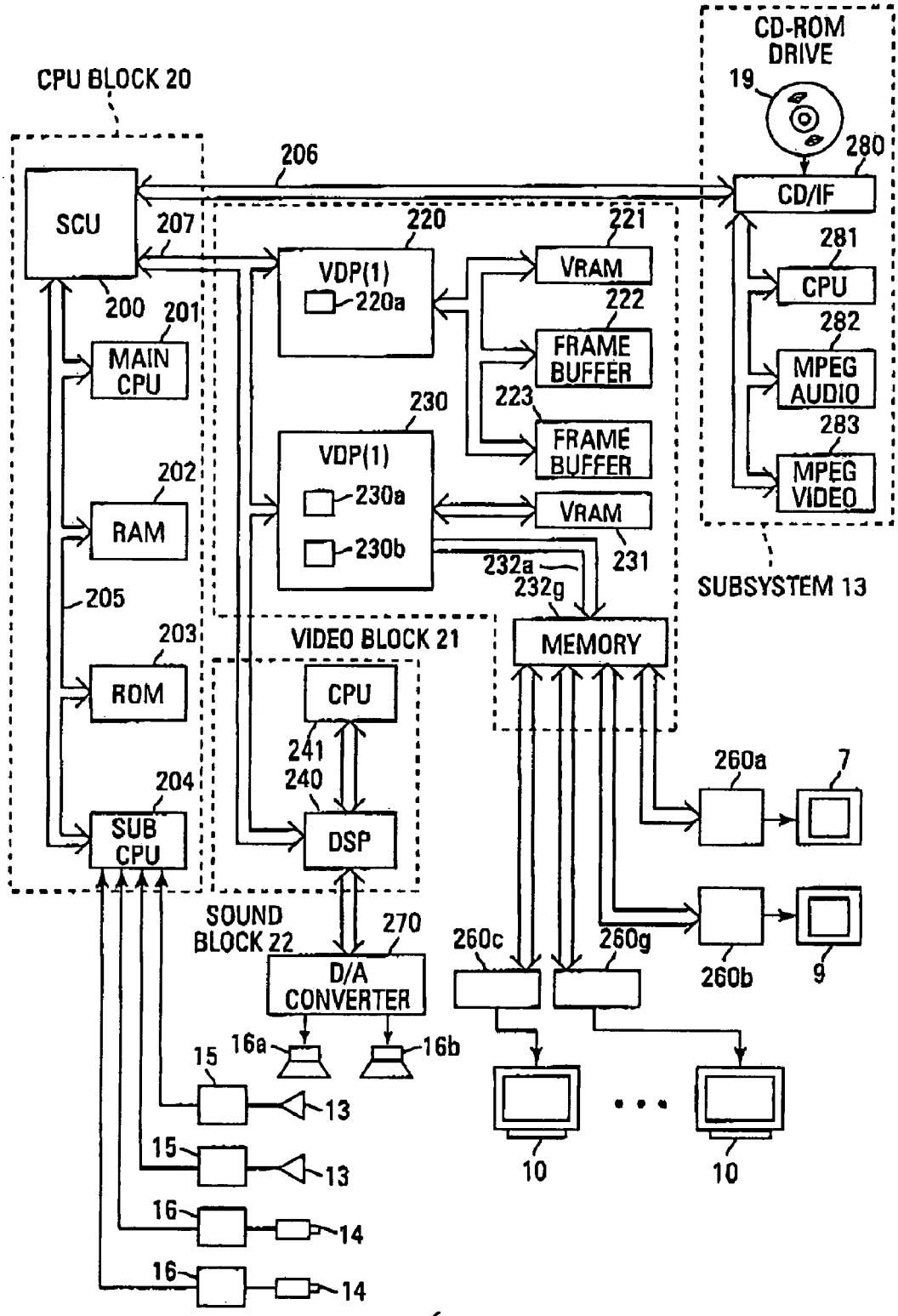
Fig. 4 Prior Art
FIG. 4 shows a block schematic of the electronic configuration of a prior art animated gaming system.

FIG. 4 shows the schematic circuitry of a prior art automated system as disclosed in U.S. Patent Application No. 2003/0199316. FIG. 4 is a block diagram of processing circuitry in the game device of FIG. 1. The game device housing comprises a CPU block 20 for controlling the whole device, a picture block 21 for controlling the game screen display, a sound block for producing effect sounds and the like, and a subsystem for reading out CD-ROM. The CPU block 20 comprises an SCU (System Control Unit) 200, a main CPU 201, RAM 202, RAM 203, a sub-CPU 204, and a CPU bus 205. The main CPU 201 contains a math function similar to a DSP (Digital Signal Processing) so that application software can be executed rapidly.

The RAM 202 is used as the work area for the main CPU 201. The RAM 203 stores the initialization program used for the initialization process. The SCU 200 controls the busses 205, 206 and 207 so that data can be exchanged smoothly among the VEPs 220 and 230, the DSP 241, and other components.

The SCU 200 contains a DMA controller, allowing data (polygon data) for character(s) in the game to be transferred to the VRAM in the picture block 21. This allows the game machine or other application software to be executed rapidly. The sub-CPU 204 is termed an SMPC (System Manager & Peripheral Control). Its functions include collecting sound recognition signals from the sound recognition circuit 15 or image recognition signals from the image recognition circuit 16 in response to requests from the main CPU 201. On the basis of sound recognition signals or image recognition signals provided by the sub-CPU 204, the main CPU 201 controls changes in the expression of the character(s) appearing on the game screen, or performs image control pertaining to game development, for example. The picture block 21 comprises a first VDP (Video Display Processor) 220 for rendering TV game polygon data characters and polygon screens overlaid on the background image, and a second VDP 230 for rendering scrolling background screens, performing image synthesis of polygon image data and scrolling image data based on priority (image priority order), performing clipping, and the like. The first VDP 220 houses a system register 220*a*, and is connected to the VRAM (DRAM) 221 and to two frame buffers 222 and 223. Data for rendering the polygons used to represent TV game characters and the like is sent to the first VDP 220 through the main CPU 220, and the rendering data written to the VRAM 221 is rendered in the form of 16- or 8-bit pixels to the rendering frame buffer 222 (or 223). The data in the rendered frame buffer 222 (or 223) is sent to the second VDP 230 during display mode. In this way, buffers 222 and 223 are used as frame buffers, providing a double buffer design for switching between rendering and display for each individual frame. Regarding information for controlling rendering, the first VDP 220 controls rendering and display in accordance with the instructions established in the system register 220*a* of the first VDP 220 by the main CPU 201 via the SCU 200.

The second VDP 230 houses a register 230*a* and color RAM 230*b*, and is connected to the VRAM 231. The second VDP 230 is connected via the bus 207 to the first VDP 220 and the SCU 200, and is connected to picture output terminals Voa through Vog through memories 232*a* through 232*g* and encoders 260*a* through 260*g*. The picture output terminals Voa through Vog are connected through cables to the display 7 and the satellite displays 10.

Scrolling screen data for the second VDP 230 is defined in the VRAM 231 and the color RAM 230*b* by the CPU 201 through the SCU 200. Information for-controlling image display is similarly defined in the second VDP 230. Data defined in the VRAM 231 is read out in accordance with the contents established in the register 230*a* by the second VDP 230, and serves as image data for the scrolling screens that portray the background for the character(s). Image data for each scrolling screen and image data of texture-mapped polygon data sent from the first VDP 220 is assigned display priority (priority) in accordance with the settings in the register 230*a*, and the final image screen data is synthesized.

Where the display image data is in palette format, the second VDP 230 reads out the color data defined in the color RAM 230*b* in accordance with the values thereof, and produces the display color data. Color data is produced for each display 7 and 9 and for each satellite display 10. Where display image data is in RGB format, the display image data is used as-is as display color data. The display color data is temporarily stored in memories 232*a*-232*f* and is then output to the encoders 260*a*-260*f*. The encoders 260*a*-260*f* produce picture signals by adding synchronizing signals to the image data, which is then sent via the picture output terminals Voa through Vog to the display 7 and the satellite displays 10. In this way, the images required to conduct an interactive game are displayed on the screens of the display 7 and the satellite displays 10.

The sound block 22 comprises a DSP 240 for performing sound synthesis using PCM format or FM format, and a CPU 241 for controlling the DSP 240. Sound data generated by the DSP 240 is converted into 2-channel sound signals by a D/A converter 270 and is then presented to audio output terminals Ao via interface 271. These audio output terminals Ao are connected to the input terminals of an audio amplification circuit. Thus, the sound signals presented to the audio output terminals Ao are input to the audio amplification circuit (not shown). Sound signals amplified by the audio amplification circuit drive the speakers 16*a* and 16*b*. The subsystem 23 comprises a CD-ROM drive 19*b*, a CD-I/F 280, and CPU 281, an MPEG-AUDIO section 282, and an MPEG-PICTURE section 283. The subsystem 23 has the function of reading application software provided in the form of a CD-ROM and reproducing the animation. The CD-ROM drive 19*b* reads out data from CD-ROM. The CPU 281 controls the CD-ROM drive 19*b* and performs error correction on the data read out by it. Data read from the CD-ROM is sent via the CD-I/F 280, bus 206, and SCU 200 to the main CPU 201 that uses it as the application software. The MPEG-AUDIO section 282 and the MPEG-PICTURE section 283 are used to expand data that has been compressed in MPEG (Motion Picture Expert Group) format. By using the MPEG-AUDIO section 282 and the MPEG-PICTURE section 283 to expand data that has been compressed in MPEG format, it is possible to reproduce motion picture. It should be noted herein that there are distinct processor for the CPU block, video block, sound block, CD-ROM drive and Memory with their independent PCU's. This requires significant computing power and still has dumb (no intelligence) player input components.

Figure 5:
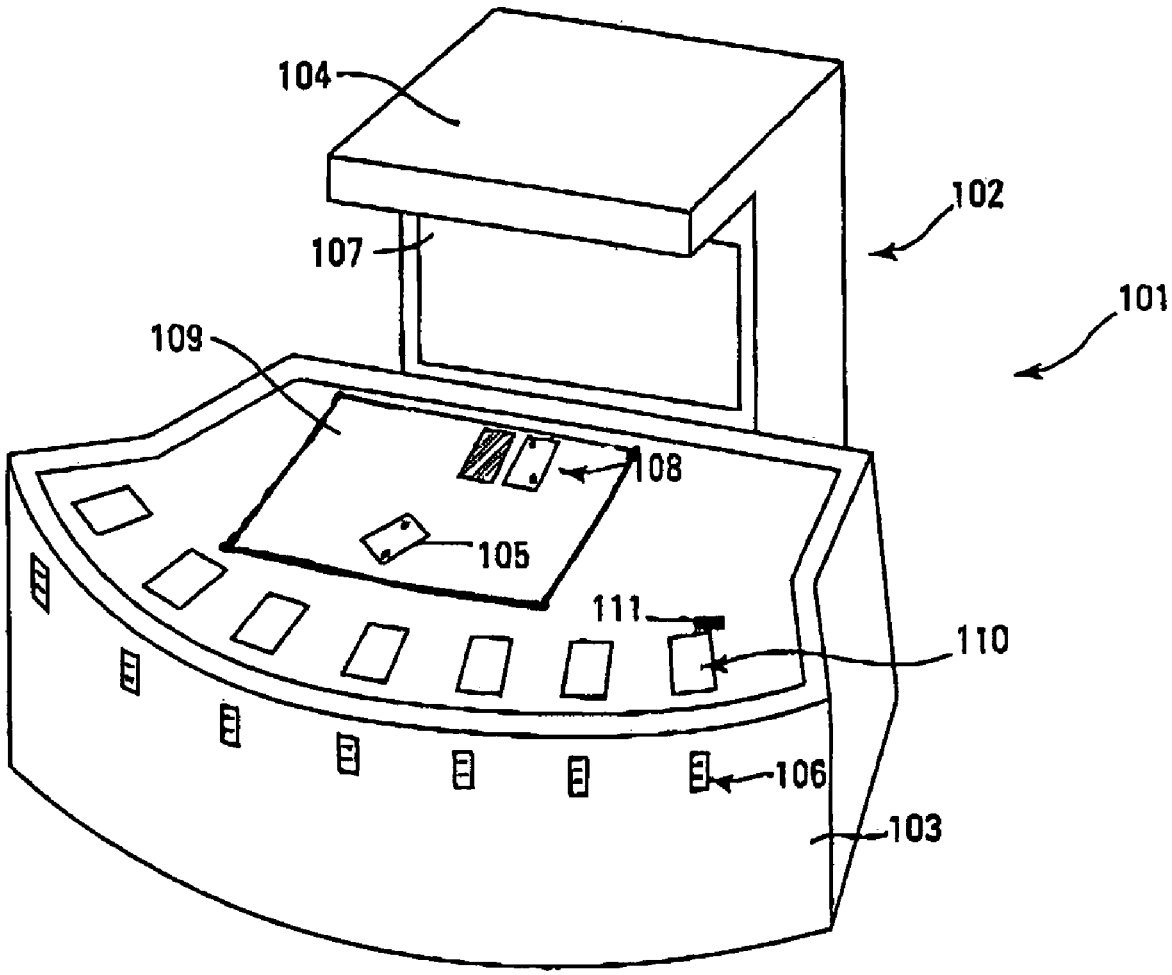
FIG. 5 shows a perspective view of a format for an automated gaming system according to the present invention.

FIG. 5 shows an example of an automated table system 101 useful to practice the game play methods of the present invention. The system 101 has an upright dealer display cabinet 102 with a top 104 and the dealer viewing screen 107 which may be any form of display screen such as a CRT, plasma screen, liquid crystal screen, LED screen or the like. The player bank arrangement 103 has a continuous display screen 109 on which images of cards being dealt 105, dealer's cards 108, bets wagered 111 and touch screen player input functions 110 are displayed. Other player input functions may be provided on a panel 106 which might accept currency, coins, tokens, identification cards, player tracking cards, ticket in/ticket out acceptance, and the like.

Figure 6:
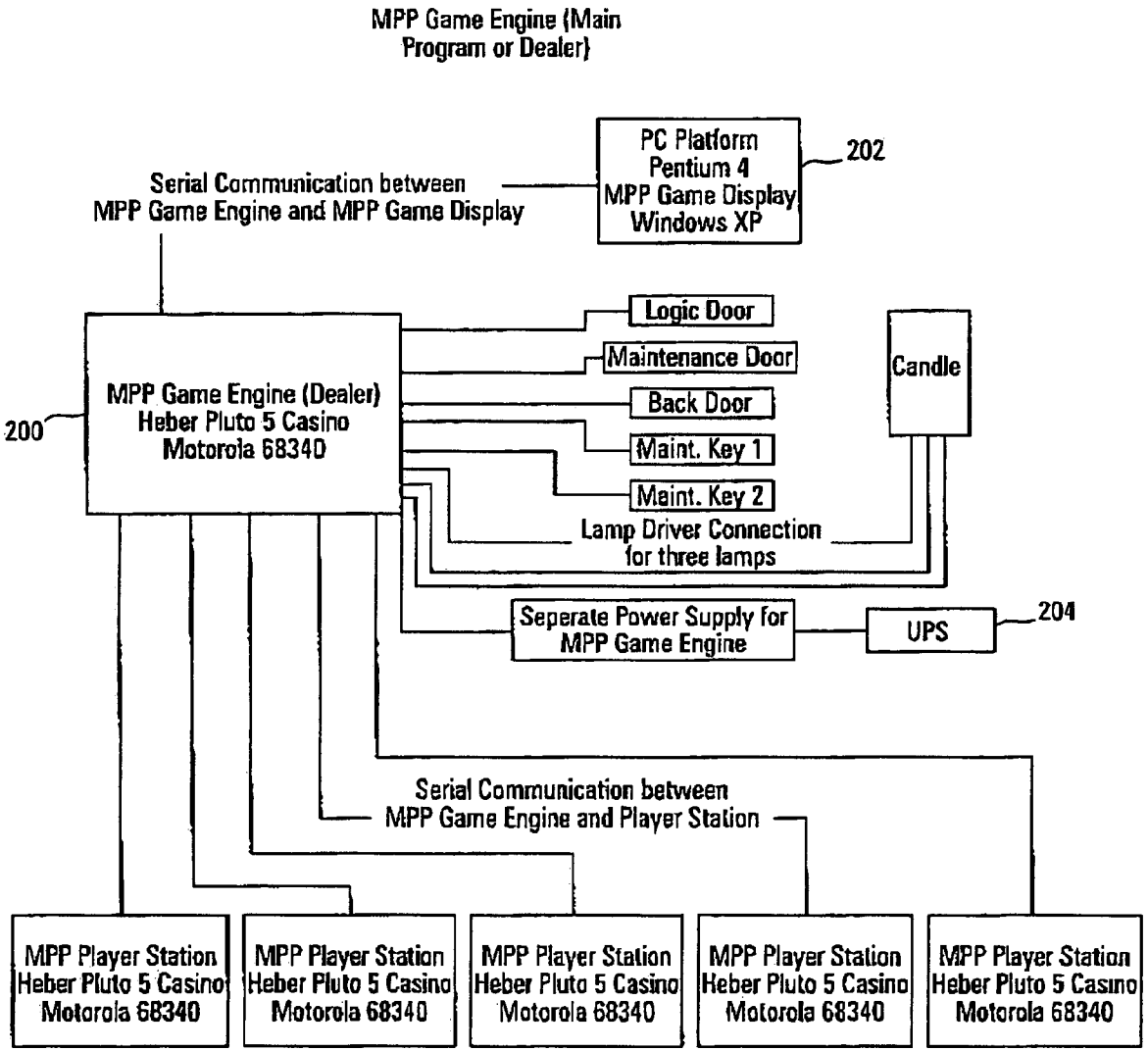
FIG. 6 shows a frontal view of a gaming engine useful in the practice of the present invention.

FIG. 6 shows an electronic/processor schematic for a MultiPlayer Platform (MPP) gaming system according to the presently described system. The MPP Game engine (dealer) comprises a Heber Pluto 5 casino game board 200 (Motorola 68340 board) operating off the PC Platform Pentium® 4 MPP Game Display processor 202. The game display processor operates on a Windows XP platform. The respective subcomponents on the Pentium 4 processor are labeled to show the apportionment of activity on the motherboard and the component parts added to the board. As is shown, the game engine has an Uninterruptible Power Supply 204. The game display processor directs activity on the Speakers, directs activities onto the MPP Game Service panel, and the Plasma Monitor Card Table display. It is important to note that all communications are direct from the game display processor, freeing up resources available to the game engine processor.

Figure 7:
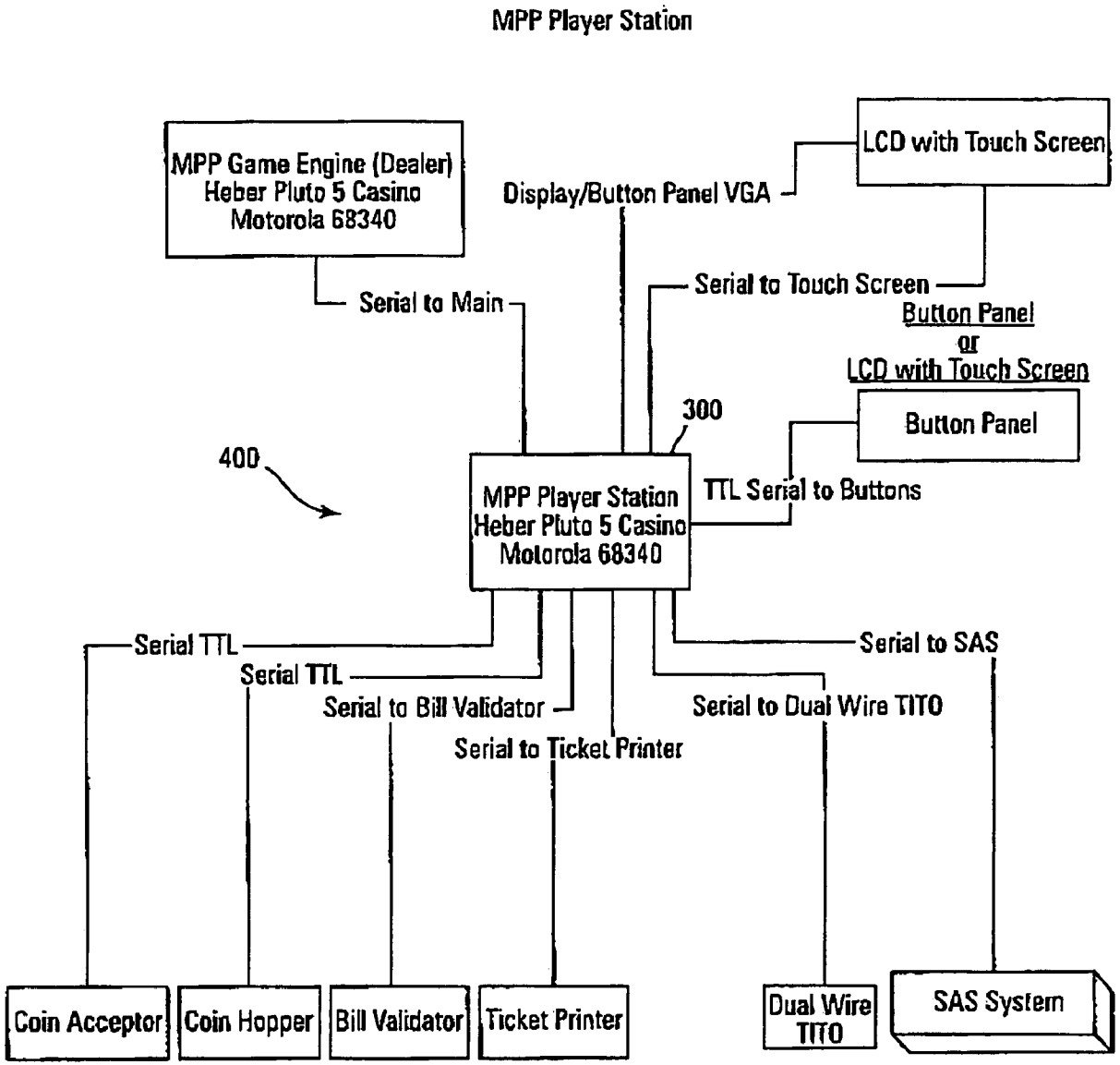
FIG. 7 shows a schematic of a player station useful in the practice of the present invention.

FIG. 7 shows the electronic/processing schematics of the MPP Player Station Intelligence board (Heber Pluto 5 Casino, Motorola 68340), each of which player stations (one for each player position) is in direct connection to the MPP Game Engine (Dealer), which is in turn directly connected to the PC Platform. (not shown in this Figure). Each Intelligence board receives information for all player input systems specific to that player station, such as the shown Coin Acceptor, Coin Hopper, Bill validator, Ticket Printer, Touch Screen and/or Display Button Panel, Dual Wire Ticket-in-Ticket-Out Printing and SAS System (SAS is one exemplary standard communications protocol used by a number of casinos central computer systems.) A significant benefit resides in the use of the independent Intelligence boards at each player position being in direct communication with the MPP Game Engine 300, as opposed to each individual player position button panel being dead or inactive until authorized by the main game processor, as previous automated gaming systems were constructed.

The above-described architecture is also an improvement in providing a system with not only the intelligence at each player position, but also in redistributing processing capability for functions among various processing components within the gaming system. In one architectural format, all functions of the gaming engine, except for the player localized intelligence functions, are consolidated into a single PC (e.g., the Pentium 4 shown in the Figures). This would include all game functions, player video functions, dealer video functions, dealer audio functions, security, central reporting (to a casino's central computer, for example), currency and debit functions, alarm functions, lighting functions, and all other peripherals on the system, except for the localized player functions. Alternatively, all functions requiring communication with the casino's main computer system are located on the player station intelligent boards. In this system, the main game processor would talk directly with the player intelligent boards, preferably in the same novel communication format described below.

Figure 8:
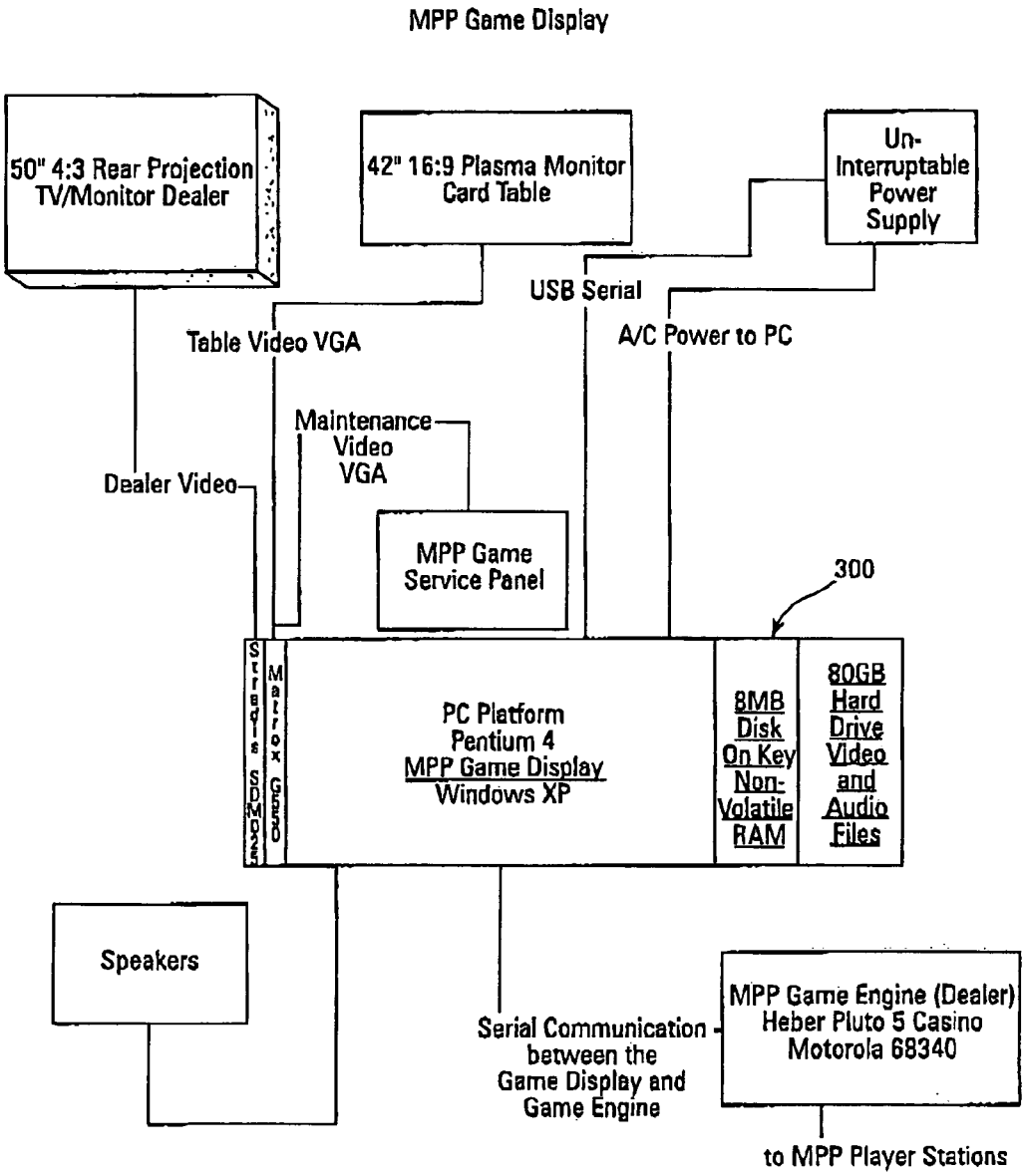
FIG. 8 shows a schematic of a preferred embodiment of a game display useful in the practice of the present invention.

An alternative system is shown in FIGS. 6, 7 and 8, where there is a dealer engine processor intermediate the main game PC and the Player intelligent boards. Both systems are a distinct improvement over the prior art, but with the higher power available for PC's, and with the ease of programming a PC as opposed to an embedded system, the consolidation of the game functions and the ability of the main game engine to communicate with each of the player positions is enabled. As shown in FIG. 8, the Game display processor 300 is preferably a Pentium® 4 PC and is separate from the main processor. With the player intelligent boards, the main game PC can receive packets of information from each player station as events occur rather than having to poll each player position on a regular basis 100 times to gain the specific information for each player input that may be made.

A description of the Heber Board, (an exemplary board that can be used as a player station processor and/or game engine processor 16) a commercially available intelligent processing board is as follows. The Heber Board is known for its reliability and flexibility, especially for the Pluto 5 family of gaming products. The Pluto 5 is the controller of choice for the global gaming industry. Flexibility comes from a set of features built into the Pluto 5 (Casino) controller, and from the choice of optional add-on boards that can be used to adapt the Pluto family to best suit individual applications. In the area of interfacing, there are three distinct boards, each of which serves a particular function in helping the Pluto 5 to connect with the world outside:

RS485 Board

RS485 is an industrial-grade board for linking multiple systems in unforgiving circumstances for centralized information gathering. The Heber RS485 board is fully opto-isolated to provide complete circuit safety when used within 'electrically noisy' environments. The RS485 board uses a single RS232 connection to the Pluto 5 board and all necessary power is also derived through this link. Two header connectors may be provided for the RS485 channel to allow daisy chain connections between multiple systems.

HII/ccTalk Board

This board specializes in communicating with industry standard note/coin acceptors and payout hoppers. Equipped with dual communication channels, each port is configurable to use either the HII format to connect with Mars® coin/note acceptors or the ccTalk format for Money Controls® hoppers. Both channels are controlled via a single RS232 connection to the Pluto 5 board and all necessary power is also derived through this link. The Heber FastTrack™ package contains modular library functions for passing information via these channels.

Four Channel Relay Board

The relay board allows control of medium- to high-level loads such as solenoids, without risk of damage or interference to the Pluto 5 circuitry. Four power-switching channels are available with absolute isolation from the Pluto 5 control signals. Each relay is capable of switching direct or alternating currents of up to 7 A at a maximum voltage of 250V.

Like the Pluto 5 board itself, its modular options have been used extensively so that their designs are fully developed and entirely stable. The options that are specified are consistently provided in mass quantities. As with all Pluto products, programming for the modular options is straightforward. This is enhanced with the use of the Pluto 5 Enhanced Development Kit and also the FastTrack™ package. Between them, these kits contain all of the low level and high level programming tools and library functions needed for gaming applications. These systems can be provided through a Pluto 5 Enhanced Development Kit datasheet 80-15353-7 (Heber Limited, Belvedere Mill, Chalford, Stroud, Gloucestershire, GL6 8NT, UK Tel: +44 (0) 1453 886000 Fax: +44 (0) 1453 885013 www.heber.co.uk. Specifications for the various boards are identified below.

RS485 Interface

Host Interface
RS232 connection to Pluto 5/Pluto 5 Casino
All power provided via RS232 link from host system Communication Port
Dual four-way Molex 0.1" KK headers for daisy chaining purposes Dimensions
80×61 mm (3.14×2.4")

Part Number
Opto-isolated RS485 board
01-14536-2

HII/ccTalk Interface

Host Interface
RS232 connection to Pluto 5/Pluto 5 Casino
All power provided via RS232 link from host system Communication Port
Single or dual 10 way header connectors Dimensions
101.6×69.85 mm (4×2.8")

Part Number
Dual channel HII/ccTalk board
01-16171-2

Four Channel Relay Board

Host Interface
Connection to Pluto 5/Pluto 5 Casino via ribbon cable using four standard output lines
All power provided via ribbon cable link from host system Switching Capabilities
Up to 250V AC or DC @ 7 A maximum per channel Dimensions
80×61 mm (3.14×2.4")

Part Number
Four channel relay board
01-15275-1
80-16949-1

One proposed hardware configuration uses a "satellite" intelligent processor at each player position. The player station satellite processor is substantially the same as the primary game engine processor, a Heber Pluto 5 Casino board. The satellite processors receive instruction from the primary game engine but then handle the communications with player station peripherals independently. Each satellite processor communicates with only the peripherals at the same player station. Thus each player station has a dedicated satellite processor communicating with only the peripherals at the same player station and with the casino's central computer system. The peripherals are, but not limited to: Slot accounting Systems, Bill Validator, Ticket Printer, Coin Acceptor, Coin Hopper, Meters, Button panel or LCD touch screen and various doors and keys.

The satellite processors run proprietary software to enable functionality. The player station software is comprised of two modules, the first being an OS similar to the game engine Operating System and the second being station software that handles peripheral communications. The software may be installed on EPROMs for each satellite processor. The primary method of communication between the satellite processors and the primary game engine is via serial connectivity and the previously described protocol. In one example, information packets are prepared by the satellite processors and are sent to the game engine processor on the happening of an event.

The proposed game engine provides communication to the player stations to set the game state, activate buttons and receive button and meter information for each player station. Communication is via a serial connection to each of the stations. The new protocol for communication between the game engine, game display and player stations is an event driven packet-for-packet bi-directional protocol with Cyclic Redundancy Check (CRC) verification. This is distinguished from the Sega system that used continuous polling. This communication method frees up resources in the same engine processor because the processor no longer needs to poll the satellites continuously or periodically.

The new protocol uses embedded acknowledgement and sequence checking. The packet-for-packet protocol uses a Command Packet, Response Packet and a Synchronization Packet as illustrated below. The protocol uses standard ASCII characters to send data and a proprietary verification method.

Format of Command Packet

| STX | SEQ | DATA LENGTH | DATA | CRC-16 | ETX |
|---|---|---|---|---|---|
| 1 | 1 | 3 | 3–999 | 5 | 1 |

Format of Response Packet

| STX | SEQ | DSP | PRV | ETX |
|---|---|---|---|---|
| 1 | 1 | 1 | 1 | 1 |

| Format of Synchronization Response Packet | | | |
|---|---|---|---|
| STX | MTS | MRS | ETX |
| 1 | 1 | 1 | 1 |

| Legend For Figures | |
|---|---|
| STX | Start of Packet Character |
| SEQ | Sequence # (Cycles from '0' thru '9') |
| LEN | Length of Data Area ('003' thru '999') |
| DATA | ASCII Data Fields Separated with '\|' Character |
| CRC | CRC-16 Value ('0000' thru '65535') Cyclic Redundancy Check |
| ETX | End of Packet Character |
| DSP | Disposition Code ('A' ACK, 'N' NAK, or 'I' Invalid Sequence) |
| PRV | Sequence Number of Last ACK'ed Packet (0 thru 9) |
| MTS | Main's Current Transmit Sequence Number |
| MRS | Main's Current Receive Sequence Number |

The Command Packet and Response Packet are used during primary game communications. The protocol uses redundant acknowledgement. For example: The packet is initially acknowledged when first received by the recipient. The same recipient will resend anther acknowledgement in the next communication. This second acknowledgement is the 'PRV' data in the response packet.

The communications between the Game Engine and the Player Station intelligence is preferably a transaction-based protocol. Either device can start a transaction, which is why it is essential that there be an intelligent board at each player position. All packets of information may be sent in any acceptable format, with ASCII format preferred as a matter of designer choice. All command packets usually contain a sequence number that is incremented after each successful packet exchange. The Game Engine and the Player Station intelligence use sequence numbers that are independent of each other. The sequence number keeps the communications in synchronization. This synchronization method is described later.

The command packet is used to send various commands such as Inputs, Lamps, Doors, Errors, Chirp, Game Results, player input, coin acceptance, player identification, credit acceptance, wagers, etc . . . The command packet format may be, by ay of a non-limiting example:

| |
|---|
| <STX><Sequence number><Data Length><Data><CRC-16><ETX> |

The data format with in the command packet may be:

| |
|---|
| <Address><Command><Field 1>\|<Field 2>\|<Field n>\| |

The response packet format may be:

| |
|---|
| <STX><Sequence number><Disposition><Previous ACK><ETX> |

The sync request packet format may be:

| |
|---|
| <SYN> |

The sync response packet format may be:

| |
|---|
| <STX><Mains Current Transmission Sequence><Mains Current Receive Sequence><ETX> |

A major strength of the protocol is its resilience of the Game Protocol and its ability to free up resources within the game engine. Those resources can in turn be used to provide more intricate games, and multi-media affects.

Synchronization Method

The satellite and host must become synchronized in order to provide for reliable communications using packet numbers. To facilitate this, a novel protocol synchronization method that is used. Upon applying power to the satellite, or after a communications failure, the satellite automatically enters into synchronization mode. In the synchronization mode the satellite sends out the ASCII SYN (0×16) character about every second. It is expecting a special response packet containing transmit and receive packet sequence numbers to be used from that point on. After receiving the special response packet, the sequence numbers are used as-is, and not incremented until a successful packet exchange is completed. After communications is synchronized, the sequence numbers are incremented after each packet is successfully sent or received.

As was noted before, the main game processor may contain information, data, programming and other necessary functions to enable the play of multiple games off the same machine. The system may be controlled so that different games may be played at different times on command of the casino or players.

Figure 9:
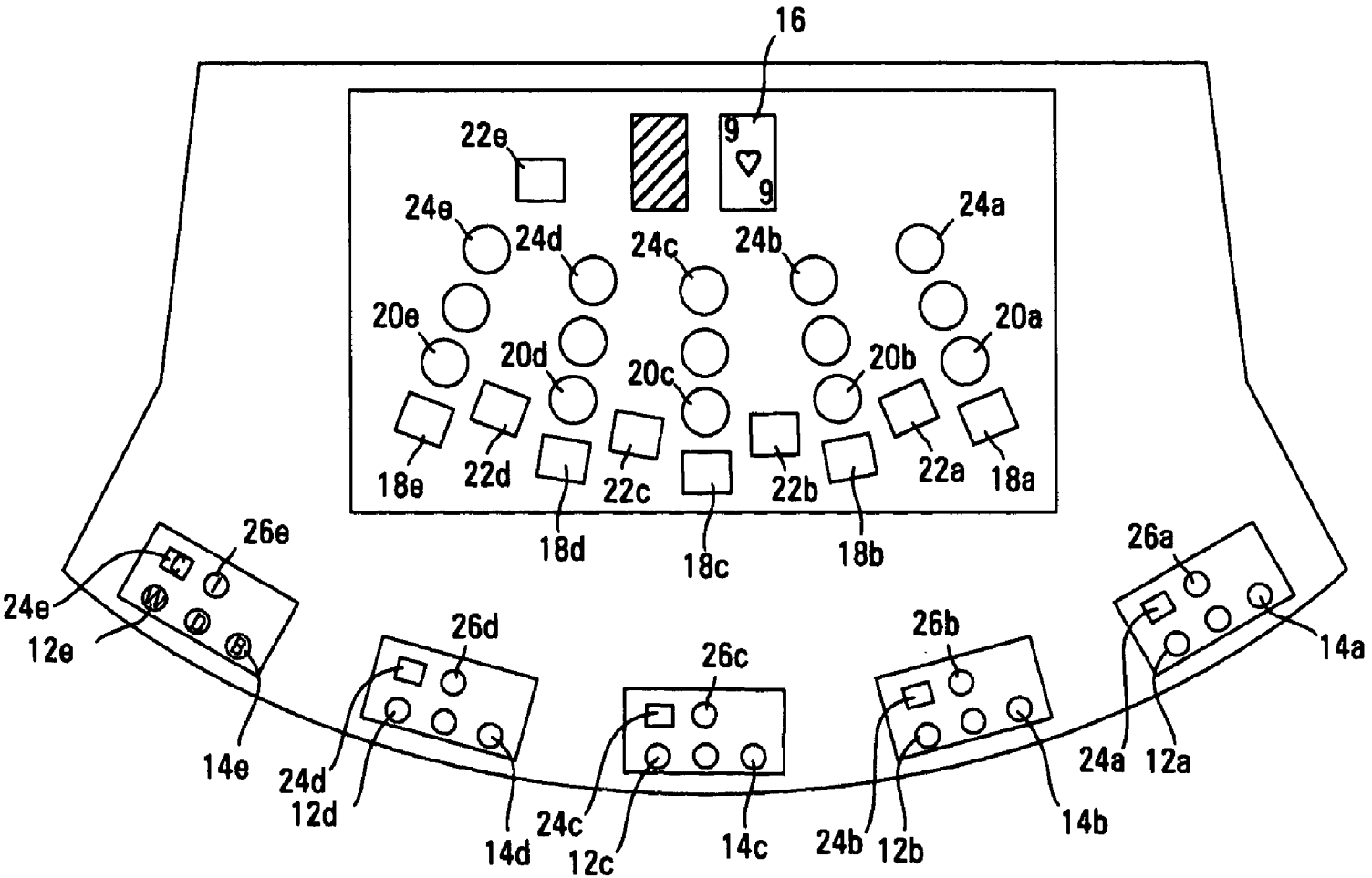
FIG. 9 shows a top plan view of a game of the present invention played on an interactive multiple player video gaming platform.

An underlying game of Blackjack or a variant of Blackjack is preferably played on an interactive gaming platform described above. As shown in FIG. 9, the player places an initial wager on the underlying game and an optional wager on a side game using key pad controls 12*a-e* and 14*a-e*. The side wager is made before any cards are displayed. The side wager is made on whether a specific rank of card will be shown in either of the two player's card areas 18*a-e* (the player who has made the wager) or in the dealer's exposed card 16. The probabilities of a specific rank of a card (as opposed to value of card, which would render 10's, Jacks, Queens and Kings equivalent) is the same, whichever card is selected, but a preferred game from an advertising standpoint, marketing standpoint or the like is the use of Jacks, with the game titled Jack Magic™ blackjack or Jacks Magic™ blackjack. The player places a side wager on an identified wager area 20*a-e* by depressing bet buttons 14*a-e*, and after the player's cards and the dealer's cards have been dealt, the side wager is resolved according to the rules of the game. A pay table 22*a-e* may display payout odds. The regular play of the Blackjack game is then continued, with no change in the underlying strategy of the game. The Jack Magic™ blackjack game may be played with certain tolerable variations. For example, when a player splits a hand (with or without any Jacks displayed in the player's hand or the dealer's hand), by depressing buttons 24*a-e* the house rules may control whether the play of Jack Magic™ blackjack continues, or whether the side bet is cancelled with only the first two cards displayed. The Jack Magic™ blackjack game may also be played where only the first card dealt with a split may be active in the side bet game. Insurance wagers may also be placed in areas 24*a-e* by depressing insurance wager buttons 26*a-e*. These variations significantly affect the payouts, the hold, and the odds in the game, so with each variation in the rules, different odds and different payout tables would have to be provided. The preferred method of play would be for the Jack Magic™ game being played on only the first two exposed cards dealt to the player in card areas 18*a-e* and the dealer's single exposed card in area 16.

A general description of the play of the game of the invention can be provided as a method of playing a wagering card game comprising an underlying card game and an auxiliary card game comprising: placing at least one wager on the underlying card game; optionally placing a wager on the auxiliary card game; dealing a first number of cards to a player; dealing a second number of cards to the dealer; displaying at least one of the player's cards; displaying at least one of the dealer's cards; wherein if at least one of the displayed player's cards or at least one of the displayed dealer's cards is a card of a specific predetermined rank, paying a player who has placed the optional wager for the occurrence of the at least one card of a specific predetermined rank being displayed in either the exposed card(s) of the dealer's hand and/or the player's hand; and then continuing deal of cards according to the rules of the underlying game and continuing play of the underlying game. The method is preferred where the underlying game comprises blackjack. The first two cards dealt to the player are usually displayed face-up.

Usually only one card dealt to the dealer is displayed face-up and the first card displayed by the dealer is used in ascertaining awards in the game. The method is preferred wherein paying a player who has placed the optional wager is based on a pay table based on the appearance of cards of specific rank on only displayed player's cards and a first displayed dealer's card.

Examples of pay tables that can be used for this method of play in the Jack Magic™ blackjack game are shown below. Note that the game can be played with varying numbers of decks (6 or 8 being preferred) and with special decks.

| | (Four Decks) | | | |
|---|---|---|---|---|
| | 1 | 2 | 3 | 4 |
| 3 one-eyed Jacks | 500 to 1 | 500 to 1 | 500 to 1 | 500 to 1 |
| 3 Jacks | 100 to 1 | 100 to 1 | 100 to 1 | 100 to 1 |
| 2 one-eyed Jacks | 50 to 1 | 50 to 1 | 50 to 1 | 40 to 1 |
| 2 Jacks | 9 to 1 | 8 to 1 | 7 to 1 | 7 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |

| | (Five Decks) | | | |
|---|---|---|---|---|
| | 1 | 2 | 3 | 4 |
| 3 one-eyed Jacks | 500 to 1 | 500 to 1 | 500 to 1 | 500 to 1 |
| 3 Jacks | 100 to 1 | 100 to 1 | 100 to 1 | 100 to 1 |
| 2 one-eyed Jacks | 50 to 1 | 50 to 1 | 40 to 1 | 40 to 1 |
| 2 Jacks | 9 to 1 | 8 to 1 | 9 to 1 | 8 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |

| | (Six Decks) | | |
|---|---|---|---|
| | 1 | 2 | 3 |
| 3 one-eyed Jacks | 500 to 1 | 500 to 1 | 500 to 1 |
| 3 Jacks | 100 to 1 | 100 to 1 | 100 to 1 |
| 2 one-eyed Jacks | 50 to 1 | 40 to 1 | 30 to 1 |
| 2 Jacks | 7 to 1 | 7 to 1 | 8 to 1 |
| 1 one-eyed Jack | 3 to 1 | 3 to 1 | 3 to 1 |
| 1 Jack | 1 to 1 | 1 to 1 | 1 to 1 |

The payout odds should be lower (because of a higher probability of occurrence of the appearance of Jacks) and the house odds would be lower with the two described variations where all hit cards during a split would be active in the game. In both of these variations, the probability of hit frequency would be higher. Similarly with a Spanish 21™ deck, with fewer ranks of cards in the deck (the cards numbered 10 have been removed, but face or court cards remain in the deck), the hit frequency of jacks increases and the house may wish to lower the payouts to compensate for the difference in probabilities. It is possible to keep the payout rate the same in the pay tables, but that would reduce the house edge. It is also possible to provide one pay table for hands where cards are not split and a separate pay table that applies where cards are split for that player.

In allowing these potential variations, the house may adjust the probabilities in its favor by excluding the splitting of player's cards where the first two cards are Aces or cards with counts of 10 (i.e., 10's, Jacks, Queens and Kings). This would still possibly benefit the player, but by allowing the player to split cards that would strategically not be split (e.g., splitting 4's and splitting fives), the probability of losing the underlying game might increase. This is a less preferred embodiment because the strategy of the underlying play of the game might be altered in certain hands, and this is considered undesirable, although it is allowable. The undesirability comes less from the player using these modified rules, but from other players at the table who may feel that the "flow of cards" is being altered by changing strategies.

Among the features that are present in the play of the preferred version of Jack Magic™ blackjack include at least the following elements:

1) The underlying game is blackjack or blackjack variations (e.g., Spanish 21™).
2) A side bet is placed with the underlying game to engage in a separately paying wagering game, e.g., Jack Magic™ blackjack.
3) The separately paying game may not interfere with any underlying strategy in the play of the underlying game or the payout on the underlying game.
4) After placement of the ordinary blackjack wager and the optional side bet wager, two cards are provided to the player (face up) and two cards are provided to the dealer, one of which is face up.
5) The player is paid on the side bet when any one or more of the three exposed cards (the two player cards of a player making the side bet and the dealer's one exposed card) is a specific rank of card according to the rules of the game, e.g., a Jack.
6) There may be different levels of payout amounts depending upon how many Jacks are shown in the three relevant cards, with increased payments for two jacks and then again for three jacks. Additional bonus awards may be made for one-eyed jacks, or multiples of one-eyed jacks (e.g., the highest bonus being for three one-eyed jacks).

7) The payout for the side bet game is preferably paid before the underlying game is continued. The game is played with larger numbers of deck supplies, with 4, 5, 6 or 8 decks to be typically used. The payout is preferably done before play of the underlying game because if the player busts, that player's cards are usually collected before other hands are resolved or played.

The following description will assist in illustrating one method of playing the game of the invention. There are a dealer and two players at a gaming table, Player 1 and Player 2. The dealer deals from a randomly shuffled set of four decks of cards. Player 1 places a wager in the underlying game of $10 and a side bet wager on Jack Magic™ blackjack game of $2, and Player 2 places a wager of $5 on the underlying Blackjack game, but places no wager on the side bet Jack Magic™ blackjack game. The dealer deals initial two-card hands of blackjack in sequence, one card at-a-time as a first card to Player 1 (face up), a first card (face up) to Player two, a first card (face down) to the dealer, a second card (face up) to Player 1, a second card (face up) to Player 2, and a second card (face up) to the dealer. The hands dealt are as follows in a series of game plays:

| Game 1 | |
|---|---|
| Player 1 Hand | 10 and 7 |
| Player 2 Hand | Jack and 6 |
| Dealer hand | Ten exposed |

In the play of this hand, there would be no payout to any player on the Jack Magic™ blackjack game. Only the first player placed the side bet wager on that game, and neither that player's hand (Player 1) nor the dealer's exposed card showed a Jack. The exposed Jack in Player 2's hand is of no consequence to the play of Jack Magic™ blackjack by Player 1. It is possible to envisage a game where the exposure of a Jack in any hand (or other designated card) could provide a payout of a much lower amount, but that is not a rule in the play of this variant of Jack Magic™ blackjack game. After determining that there would be no award for the play of Jack Magic™ blackjack in this hand, the underlying game of Blackjack would continue in a normal manner.

| Game 2 | |
|---|---|
| Player 1 Hand | Jack and 3 |
| Player 2 Hand | Jack and Ace |
| Dealer Hand | Queen (face up) and 9 |

In the play of this hand, Player 1 would receive a bonus payout based on his side bet wager because that player's hand (Player 1) contains a Jack in the first two exposed cards. Again, the exposed Jack in Player 2's hand is of no consequence to the play of the Jack Magic™ blackjack game, because Player 2 did not make the side bet. After paying off the award amount to Player 1, the game of Blackjack would continue in a normal fashion.

| Game 3 | |
|---|---|
| Player 1 Hand | Ace and 10 |
| Player 2 Hand | 3 and 6 |
| Dealer Hand | Jack (face down) and 8 |

In the play of this hand, there would be no Jack Magic™ blackjack award. The position of the dealer's Jack as a face down card precludes that Jack from any effect on the awards in the Jack Magic™ blackjack game. After determining that there would be no award for the play of Jack Magic™ blackjack in this hand, the underlying game of Blackjack would continue in a normal manner.

| Game 4 | |
|---|---|
| Player 1 Hand | 6 and 9 |
| Player 2 Hand | Ace and 2 |
| Dealer Hand | Jack (face up) and Ace |

In the play of this hand, there would be an immediate payout to Player 1 for the Jack Magic™ blackjack game because the dealer's hand has an exposed jack on the first two cards. The fact that the dealer has a blackjack does not affect the Player's ability to win the Jack Magic™ blackjack side bet. Player 2 has not placed the side bet and therefore does not collect on the dealer's Jack. After paying off the Jack Magic™ blackjack wager, all underlying wagers from Player 1 and Player 2 are collected by the house.

| Game 5 | |
|---|---|
| Player 1 Hand | Jack and 4 |
| Player 2 Hand | King and 5 |
| Dealer Hand | Jack (face up) and 7 |

In the play of this hand, Player 1 will receive a larger award for the play of Jack Magic™ blackjack because two Jacks are engaged in the play of the game, one in the hand of Player 1 and one as the exposed card in the dealer's hand. If Player 2 had a Jack as one of the first two cards, that would not have affected the play of Jack Magic™ blackjack, unless the rules specifically allowed for that. Player 2 in this example did not make the side bet. After paying off the award amount to Player 1, the game of Blackjack would continue in a normal fashion.

As noted above, there would be larger bonuses or different bonuses if there were three Jacks exposed in the hand of Player 1 and the dealer's hand (combined), or if the rules paid for one-eyed Jacks (Jack of Hearts and Jack of Spades), if there were two one-eyed Jacks exposed, or if there were three one-eyed jacks were exposed in the deal of the hand of Player 1 and the dealer's exposed card.

In the above description, variations within the generic concept of the invention have been alluded to or described. One of ordinary skill in the art can develop other alternatives or additions within the scope of the invention. For example, special wagering features such as coin accepting slots, proximity detectors, or other wager indicators (particularly for the side bet wager) can be provided on the gaming table for the play of Jack Magic™ blackjack. Progressive bonuses may be designed for use with the appearance of special hands (e.g., three Jacks, three one-eyed Jacks, two one-eyed Jacks, or the like). Such a progressive bonus may be indicated on a special meter. Other options and components may be added to the play of the game without avoiding the underlying generic concepts disclosed in this description and the claims of the invention.

For example, the underlying game could be another casino-style card game such as baccarat, pai gow poker, or a specialty poker game such as Let it Ride® Stud Poker, for example. In the case of Let it Ride, players each receive 3 cards, face down after placing three equal bets. The dealer receives two cards, face down, that serve as common cards for all players. The players are given a chance to view their cards, and are given the option of taking back one of the bets. The dealer turns over the first community card, and the players are then given the opportunity to take back a second one of the bets. The third bet must remain up. The dealer then reveals his second community card, and each player's hand of three cards plus the two community cards is resolved against a pay table. The pay table shows payout odds for each of a predetermined group of winning hands. A side bet of the present invention could be made available for the appearance of one, two, three or four cards of the same cards, i.e.—Jacks, either from the player hand, the dealer common cards or a combination thereof. It is preferred that the layout be modified so that the player's three cards appear on a given area of the layout, and that the order in which the cards are dealt cannot be modified.

In another example, the underlying game is Pai Gow poker. Each player and the dealer receive 7 cards. The players and the dealer "set" their hands, forming a five card hand and a two card hand. A side bet on the occurrence of a designated card, such as a King in the player's two card hand and/or the dealer's 2 card hand could be offered. Or, the designated card may be in the five card hands, or combinations of the five and two card hands. Other casino games such as Baccarat could be played in a manner similar to the blackjack game described in detail above.

Although specific components, materials, sequences and rules have been provided in these descriptions to enable practice, it is clear to one skilled in the art that alternatives, variations, equivalents and the like may be used within the enabled scope of practice.

What is claimed is:

1. A multi-player platform that provides multiple player positions for live players to engage in an underlying card game with an auxiliary card game, the system providing a virtual dealer and virtual cards, the platform comprising at least two player positions that enable live players to place wagers on the underlying card game, a display system for showing a virtual dealer, a display system for showing the virtual cards used in play of the underlying card game, and a processor that contains the rules of the underlying card game, the processor enabling play for each player on the underlying card game according to the following rules:

placing at least one wager on the underlying card game;

optionally placing a wager on the auxiliary card game;

dealing a first number of cards to a player;

dealing a second number of cards to the dealer;

displaying at least one of the player's cards;

displaying at least one of the dealer's cards;

wherein if at least one of the displayed player's cards or at least one of the displayed dealer's cards is a card of a specific predetermined rank, paying a player who has placed the optional wager for the occurrence of the at least one card of a specific predetermined rank being displayed in either the exposed card(s) of the dealer's hand and/or the player's hand; and then continuing deal of cards according to the rules of the underlying game and continuing play of the underlying game.

2. The platform of claim 1 wherein the underlying game comprises blackjack.

3. The platform of claim 1 wherein the first two cards dealt to the player are displayed.

4. The platform of claim 1 wherein only one card dealt to the dealer is displayed.

5. The platform of claim 2 wherein the first two cards dealt to the player are displayed.

6. The platform of claim 2 wherein only one card dealt to the dealer is displayed.

7. The platform of claim 5 wherein only one card dealt to the dealer is displayed.

8. The platform of claim 2 wherein paying a player who has placed the optional wager is performed is based on a pay table based on the appearance of cards of specific rank on only displayed player's cards and a first displayed dealer's card.

9. The platform of claim 3 wherein paying a player who has placed the optional wager is performed is based on a pay table based on the appearance of cards of specific rank on only displayed player's cards and a first displayed dealer's card.

10. The platform of claim 4 wherein paying a player who has placed the optional wager is performed is based on a pay table based on the appearance of cards of specific rank on only displayed player's cards and a first displayed dealer's card.

11. The platform of claim 5 wherein paying a player who has placed the optional wager is performed is based on a pay table based on the appearance of cards of specific rank on only displayed player's cards and a first displayed dealer's card.

12. The platform of claim 6 wherein paying a player who has placed the optional wager is performed is based on a pay table based on the appearance of cards of specific rank on only displayed player's cards and a first displayed dealer's card.

13. The platform of claim 7 wherein paying a player who has placed the optional wager is performed is based on a pay table based on the appearance of cards of specific rank on only displayed player's cards and a first displayed dealer's card.

14. The platform of claim 2 wherein a pay table having awards that are no greater than those in the following table is used:

| Fewer Than 4 Decks | | | | |
|---|---|---|---|---|
| 3 Jacks | 100 to 1 | 100 to 1 | 100 to 1 | 100 to 1 |
| 2 one-eyed Jacks | 50 to 1 | 50 to 1 | 50 to 1 | 40 to 1 |
| 2 Jacks | 9 to 1 | 8 to 1 | 7 to 1 | 7 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |

| Four Decks | | | | |
|---|---|---|---|---|
| 3 Jacks | 100 to 1 | 100 to 1 | 100 to 1 | 100 to 1 |
| 2 one-eyed Jacks | 50 to 1 | 50 to 1 | 40 to 1 | 40 to 1 |
| 2 Jacks | 9 to 1 | 8 to 1 | 9 to 1 | 8 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |

| Six Decks | | | |
|---|---|---|---|
| 3 one-eyed Jacks | 500 to 1 | 500 to 1 | 500 to 1 |
| 3 Jacks | 100 to 1 | 100 to 1 | 100 to 1 |
| 2 one-eyed Jacks | 50 to 1 | 40 to 1 | 30 to 1 |
| 2 Jacks | 7 to 1 | 7 to 1 | 8 to 1 |
| 1 one-eyed Jack | 3 to 1 | 3 to 1 | 3 to 1 |
| 1 Jack | 1 to 1 | 1 to 1 | 1 to 1. |

15. A multi-player platform that provides multiple player positions for live players to engage in an underlying card game having an auxiliary card game, the platform providing a virtual dealer and virtual cards, the platform comprising at least two player positions that enable live players to place wagers on an underlying card game, a display system for showing a virtual dealer, a display system for showing the virtual cards used in play of the underlying card game, and a processor that contains the rules of the underlying card game, the processor enabling play for each player on the underlying card game according to the following rules with a virtual at least one, fifty-two card deck, the cards having standard rank and value, said game comprising the steps of:

placing at least one wager on the underlying card game;

optionally placing a wager on the auxiliary card game;

dealing a first number of cards to a player;

dealing a second number of cards to the dealer;

displaying at least one of the player's cards;

displaying at least one of the dealer's cards;

wherein if at least one of the displayed player's cards or at least one of the displayed dealer's cards is a card of a specific predetermined rank, paying a player who has placed the optional wager for the occurrence of the at least one card of a specific predetermined rank being displayed in either the exposed card(s) of the dealer's hand and/or the player's hand; and then continuing deal of cards according to the rules of the underlying game and continuing play of the underlying game.

16. The platform of claim 15 wherein the underlying game comprises blackjack.

17. The platform of claim 15 wherein the first two cards dealt to the player are displayed.

18. The platform of claim 15 wherein only one card dealt to the dealer is displayed.

19. The platform of claim 16 wherein the first two cards dealt to the player are displayed.

20. The platform of claim 16 wherein only one card dealt to the dealer is displayed.

21. The platform of claim 19 wherein only one card dealt to the dealer is displayed.

22. The platform of claim 16 wherein paying a player who has placed the optional wager is performed is based on a pay table based on the appearance of cards of specific rank on only displayed player's cards and a first displayed dealer's card.

23. The platform of claim 17 wherein paying a player who has placed the optional wager is performed is based on a pay table based on the appearance of cards of specific rank on only displayed player's cards and a first displayed dealer's card.

24. The platform of claim 18 wherein paying a player who has placed the optional wager is performed is based on a pay table based on the appearance of cards of specific rank on only displayed player's cards and a first displayed dealer's card.

25. The platform of claim 19 wherein paying a player who has placed the optional wager is performed is based on a pay table based on the appearance of cards of specific rank on only displayed player's cards and a first displayed dealer's card.

26. The platform of claim 20 wherein paying a player who has placed the optional wager is performed is based on a pay table based on the appearance of cards of specific rank on only displayed player's cards and a first displayed dealer's card.

27. The platform of claim 21 wherein paying a player who has placed the optional wager is performed is based on a pay table based on the appearance of cards of specific rank on only displayed player's cards and a first displayed dealer's card.

28. The platform of claim 16 wherein a pay table having awards that are no greater than those in the following table is used:

| Fewer Than 4 Decks | | | | |
|---|---|---|---|---|
| 3 Jacks | 100 to 1 | 100 to 1 | 100 to 1 | 100 to 1 |
| 2 one-eyed Jacks | 50 to 1 | 50 to 1 | 50 to 1 | 40 to 1 |
| 2 Jacks | 9 to 1 | 8 to 1 | 7 to 1 | 7 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |

| Four Decks | | | | |
|---|---|---|---|---|
| 3 Jacks | 100 to 1 | 100 to 1 | 100 to 1 | 100 to 1 |
| 2 one-eyed Jacks | 50 to 1 | 50 to 1 | 40 to 1 | 40 to 1 |
| 2 Jacks | 9 to 1 | 8 to 1 | 9 to 1 | 8 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |

| Six Decks | | | |
|---|---|---|---|
| 3 one-eyed Jacks | 500 to 1 | 500 to 1 | 500 to 1 |
| 3 Jacks | 100 to 1 | 100 to 1 | 100 to 1 |
| 2 one-eyed Jacks | 50 to 1 | 40 to 1 | 30 to 1 |
| 2 Jacks | 7 to 1 | 7 to 1 | 8 to 1 |
| 1 one-eyed Jack | 3 to 1 | 3 to 1 | 3 to 1 |
| 1 Jack | 1 to 1 | 1 to 1 | 1 to 1. |

29. A method of playing an automated wagering gaming event on a system, the system comprising:

at least two distinct video displays, a first display for showing a dealer in a card game and at least a second display showing playing cards to individual players;

at least one processor for enabling play of the wagering gaming event;

multiple player positions to enable multiple players to play the game;

wherein at least one processor can feed at least two different multiple video images and merge the at least two multiple video images to form a composite image of a dealer against a background, wherein the background comprises at least one dynamic image and the system displays images enabling play of a game according to the following rules:

placing at least one wager on the underlying card game;

optionally placing a wager on the auxiliary card game;

dealing a first number of cards to a player;

dealing a second number of cards to the dealer;

displaying at least one of the player's cards;

displaying at least one of the dealer's cards;

wherein if at least one of the displayed player's cards or at least one of the displayed dealer's cards is a card of a specific predetermined rank, paying a player who has placed the optional wager for the occurrence of the at least one card of a specific predetermined rank being displayed in either the exposed card(s) of the dealer's hand and/or the player's hand; and then continuing deal of cards according to the rules of the underlying game and continuing play of the underlying game.

30. The method of claim 29 wherein the underlying game comprises blackjack.

31. The method of claim 29 wherein the first two cards dealt to the player are displayed.

32. The method of claim 29 wherein only one card dealt to the dealer is displayed.

33. The method of claim 30 wherein the first two cards dealt to the player are displayed.

34. The method of claim 30 wherein only one card dealt to the dealer is displayed.

35. The method of claim 33 wherein only one card dealt to the dealer is displayed.

36. The method of claim 30 wherein paying a player who has placed the optional wager is performed is based on a pay table based on the appearance of cards of specific rank on only displayed player's cards and a first displayed dealer's card.

37. The method of claim 31 wherein paying a player who has placed the optional wager is performed is based on a pay table based on the appearance of cards of specific rank on only displayed player's cards and a first displayed dealer's card.

38. The method of claim 32 wherein paying a player who has placed the optional wager is performed is based on a pay table based on the appearance of cards of specific rank on only displayed player's cards and a first displayed dealer's card.

39. The method of claim 33 wherein paying a player who has placed the optional wager is performed is based on a pay table based on the appearance of cards of specific rank on only displayed player's cards and a first displayed dealer's card.

40. The method of claim 34 wherein paying a player who has placed the optional wager is performed is based on a pay table based on the appearance of cards of specific rank on only displayed player's cards and a first displayed dealer's card.

41. The method of claim 35 wherein paying a player who has placed the optional wager is performed is based on a pay table based on the appearance of cards of specific rank on only displayed player's cards and a first displayed dealer's card.

42. The method of claim 30 wherein a pay table having awards that are no greater than those in the following table is used:

| Fewer Than 4 Decks | | | | |
|---|---|---|---|---|
| 3 Jacks | 100 to 1 | 100 to 1 | 100 to 1 | 100 to 1 |
| 2 one-eyed Jacks | 50 to 1 | 50 to 1 | 50 to 1 | 40 to 1 |
| 2 Jacks | 9 to 1 | 8 to 1 | 7 to 1 | 7 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |

| Four Decks | | | | |
|---|---|---|---|---|
| 3 Jacks | 100 to 1 | 100 to 1 | 100 to 1 | 100 to 1 |
| 2 one-eyed Jacks | 50 to 1 | 50 to 1 | 40 to 1 | 40 to 1 |
| 2 Jacks | 9 to 1 | 8 to 1 | 9 to 1 | 8 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |

| Six Decks | | | |
|---|---|---|---|
| 3 one-eyed Jacks | 500 to 1 | 500 to 1 | 500 to 1 |
| 3 Jacks | 100 to 1 | 100 to 1 | 100 to 1 |
| 2 one-eyed Jacks | 50 to 1 | 40 to 1 | 30 to 1 |
| 2 Jacks | 7 to 1 | 7 to 1 | 8 to 1 |
| 1 one-eyed Jack | 3 to 1 | 3 to 1 | 3 to 1 |
| 1 Jack | 1 to 1 | 1 to 1 | 1 to 1. |

43. An automated wagering gaming event system comprising:

at least two distinct video displays, a first dealer display for showing a foreground image of a dealer in a card game, and at least a second display showing playing cards to individual players;

at least one processor for enabling play of the wagering gaming event;

multiple player positions to enable multiple players to play the game;

wherein at least one of the processors can feed at least three different sets of video image data and merge the at least three multiple video images to form a composite image of a dealer against a background, the processor feeding at least one set as a mask layer and at least one set as an auxiliary dynamic background image, the system implementing play of a game according to the rules:

placing at least one wager on the underlying card game;

optionally placing a wager on the auxiliary card game;

dealing a first number of cards to a player;

dealing a second number of cards to the dealer;

displaying at least one of the player's cards;

displaying at least one of the dealer's cards;

wherein if at least one of the displayed player's cards or at least one of the displayed dealer's cards is a card of a specific predetermined rank, paying a player who has placed the optional wager for the occurrence of the at least one card of a specific predetermined rank being displayed in either the exposed card(s) of the dealer's hand and/or the player's hand; and then continuing deal of cards according to the rules of the underlying game and continuing play of the underlying game.

44. The platform of claim 43 wherein the underlying game comprises blackjack.

45. The platform of claim 43 wherein the first two cards dealt to the player are displayed.

46. The platform of claim 43 wherein only one card dealt to the dealer is displayed.

47. The platform of claim 44 wherein the first two cards dealt to the player are displayed.

48. The platform of claim 44 wherein only one card dealt to the dealer is displayed.

49. The platform of claim 44 wherein a pay table having awards that are no greater than those in the following table is used:

| Fewer Than 4 Decks | | | | |
|---|---|---|---|---|
| 3 Jacks | 100 to 1 | 100 to 1 | 100 to 1 | 100 to 1 |
| 2 one-eyed Jacks | 50 to 1 | 50 to 1 | 50 to 1 | 40 to 1 |
| 2 Jacks | 9 to 1 | 8 to 1 | 7 to 1 | 7 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |

| Four Decks | | | | |
|---|---|---|---|---|
| 3 Jacks | 100 to 1 | 100 to 1 | 100 to 1 | 100 to 1 |
| 2 one-eyed Jacks | 50 to 1 | 50 to 1 | 40 to 1 | 40 to 1 |
| 2 Jacks | 9 to 1 | 8 to 1 | 9 to 1 | 8 to 1 |

-continued

| Four Decks | | | | |
|---|---|---|---|---|
| 1 one-eyed Jack | 3 to 1 | 3 to 1 | 3 to 1 | 3 to 1 |
| 1 Jack | 1 to 1 | 1 to 1 | 1 to 1 | 1 to 1 |

| Six Decks | | | |
|---|---|---|---|
| 3 one-eyed Jacks | 500 to 1 | 500 to 1 | 500 to 1 |
| 3 Jacks | 100 to 1 | 100 to 1 | 100 to 1 |
| 2 one-eyed Jacks | 50 to 1 | 40 to 1 | 30 to 1 |
| 2 Jacks | 7 to 1 | 7 to 1 | 8 to 1 |
| 1 one-eyed Jack | 3 to 1 | 3 to 1 | 3 to 1 |
| 1 Jack | 1 to 1 | 1 to 1 | 1 to 1. |

* * * * *